US006338940B1

(12) United States Patent
Miyazawa et al.

(10) Patent No.: US 6,338,940 B1
(45) **Date of Patent: *Jan. 15, 2002**

(54) SILVER HALIDE PHOTOGRAPHIC LIGHT SENSITIVE MATERIALS AND IMAGE FORMING METHOD BY USE THEREOF

(75) Inventors: Kazuhiro Miyazawa; Junji Ito; Yumiko Nimura; Shinichi Suzuki, all of Hino; Makoto Kaga; Shuji Murakami, both of Odawara, all of (JP)

(73) Assignee: Konica Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/330,943

(22) Filed: Jun. 11, 1999

(30) Foreign Application Priority Data

| | | |
|---|---|---|
| Jun. 26, 1998 | (JP) | 10-196579 |
| Jul. 22, 1998 | (JP) | 10-206369 |
| Sep. 28, 1998 | (JP) | 10-273514 |

(51) Int. Cl.[7] ..... G03C 1/005; G03C 1/08

(52) U.S. Cl. ..... 430/505; 430/506; 430/567; 430/569

(58) Field of Search ..... 430/505, 506, 430/567, 569

(56) References Cited

U.S. PATENT DOCUMENTS

| | | | | |
|---|---|---|---|---|
| 3,062,651 A | * | 11/1962 | Hillson | 430/569 |
| 3,124,458 A | * | 3/1964 | Fry et al. | 430/569 |
| 4,334,012 A | * | 6/1982 | Mignot | 430/567 |
| 5,523,200 A | * | 6/1996 | Hahm et al. | 430/569 |
| 5,700,631 A | * | 12/1997 | Lok et al. | 430/567 |
| 5,874,207 A | * | 2/1999 | Oyagi et al. | 430/596 |
| 5,972,588 A | * | 10/1999 | Nabeta | 430/567 |

OTHER PUBLICATIONS

Research Disclosure 17643 p. 23, Dec. 1978.*

* cited by examiner

*Primary Examiner*—Janet Baxter
*Assistant Examiner*—Amanda C. Walke
(74) *Attorney, Agent, or Firm*—Frishauf, Holtz, Goodman, Langer & Chick, P.C.

(57) ABSTRACT

A silver halide photographic light sensitive material IS DISCLOSED, comprising a support having thereon a yellow dye image forming layer, a magenta dye image forming layer and a cyan dye image forming layer, wherein when the photographic material is subjected to exposure of not more than $10^{-3}$ sec. per pixel element and further to color developing to form yellow, magenta and cyan images, a variation at multiple exposure, based on non-multiple exposure, of an average gradation, which is a slope that connects two pints corresponding to densities of 0.5 and 1.5 on a characteristic curve of each of the yellow, magenta and cyan images, is not more than 10%.

5 Claims, 1 Drawing Sheet

SILVER HALIDE PHOTOGRAPHIC LIGHT SENSITIVE MATERIALS AND IMAGE FORMING METHOD BY USE THEREOF

FIELD OF THE INVENTION

The present invention relates to silver halide photographic light sensitive materials achieving reduced image unevenness on scanning exposure, reduced doubling in super-fine line reproduction and reduced bleeding-fringes of black text images, and an image forming method by use thereof.

BACKGROUND OF THE INVENTION

Silver halide photographic light sensitive materials (hereinafter, also simply referred to as photographic materials), which have superior characteristics such as high sensitivity and superior gradation, as compared to other print materials, are extensively employed. Recently, opportunities of treating images as digital data has rapidly increased along with enhancements in computing capability of computers and advancements in network technology. Image information digitized using a scanner can readily be edited or converted on a computer and addition of data such as characters or illustrations can also be easily performed. To reproduce such digitized image information in the form of silver halide photography, it is necessary to conduct exposure by varying the exposure amount in accordance with the image information. There are some exposing methods known in the art. Specifically, scanning exposure of photographic materials with modulated light beam, based on digital data, is advantageous in terms of exposure speed and image quality. There is generally employed a method of exposing a photographic material by a combination of raster-scanning a light beam in the horizontal direction (main scanning) and transporting the photographic material in the vertical direction at the same time to shift the raster-scanning position relatively to the photographic material (sub-scanning), and a method of arranging transport of the photographic material in the direction vertical to the exposing head in which light sources are set in array (in this case, only main scanning). However, there have been problems that periodical unevenness of densities tended to occur, corresponding to the sub-scanning pitch (in cases of an array-formed exposure head, a spacing between light sources). To perform more definite exposure, the light beam diameter is desirably decreased to enhance the picture element density. However, as the light beam diameter decreases, the scanning unevenness tends to be greater. To solve such problems, JP-A 4-249244, 5-19423 and 9-304890 (herein the term, JP-A means an unexamined, published Japanese Patent Application) disclose a technique of exposure by making the sub-scanning pitch smaller than the light beam radius to result in overlap between rasters.

Image density unevenness can be reduced by optimally setting the light beam diameter to result in overlap between rasters. In this exposure method, however, it was found that printed color tone difference was produced between superfine lines with a thickness close to the light beam diameter and a relatively broad area portions, both being substantially the same density on the computer, and the fringe of black text image tended to bleed; therefore, improvements thereof are still desired.

It is well known that in conventional printing on color paper through a processed color negative film (analog exposure), there is a relationship between gradation and sharpness of the color paper. To reduce deterioration in sharpness due to irradiation and halation, a technique of incorporating various kinds of dyes into a photographic material is common. In analog exposures, prevention of fringe bleeding of black text images and color doubling of superfine lines can be achieved by adjusting gradation of color paper and adjusting sharpness of yellow, magenta and cyan images through optimal adjustment of the dye content. In scanning exposure with light beam, however, such techniques were insufficient to solve the problems described above.

Furthermore, a number of techniques of preparation of silver halide grains have been disclosed as a method for solving problems regarding high intensity reciprocity law failure. Examples thereof include a technique of improving sensitivity by forming a high bromide silver halide phase in the vicinity of the grain surface, as described in JP-A 58-108533; a technique of incorporating fine silver bromide grains, as described in JP-A 64-6941; and a technique of allowing iridium to be contained in the high bromide localized phase. U.S. Pat. No. 5,627,020 discloses a technique of adding fine silver bromide metal-doped grains. However, these techniques describe nothing with respect to an improvement of fine line reproduction described above. JP-A 7-20596 discloses a technique of incorporating an organic desensitizer into a hydrophilic colloidal layer. This disclosure concerns improvements in handling characteristics and storage stability of roomlight handling photographic materials, but nothing was suggested therein with respect to improvement of image quality on high intensity exposure and there is no description concering addition of an organic desensitizer and effects thereof. JP-A 6-11789 discloses a technique of separately adding a chemical sensitizer. This technique, which is directed to enhancing sensitivity of silver iodobromide, teaches nothing with respect to improving image quality of high chloride silver halide photographic materials when exposed to high intensity light. U.S. Pat. No. 5,744,287 discloses a technique of controlling the gradation and fill-in maximum density so as to be within a given range. This technique, however, was proved to be insufficient to improve doubling in superfine line reproduction and fringe-bleeding of black text images. It is assumed to be due to the fact that the fill-in maximum density is a parameter calculated based on the extent of fill-in of reverse-line image portions. In such case, image portions of both sides of the reverse-line image portion are affected by multi-exposure. Contrary to that, the superfine line image portions having a width of one pixel or so, were not affected by multi-exposure.

SUMMARY OF THE INVENTION

Accordingly, an object of the present invention is to provide silver halide photographic light sensitive materials achieving reduced image unevenness on scanning exposure, reduced doubling in super fine line reproduction and reduced bleeding fringe of black text images, and an image forming method by use thereof.

The object of the invention can be accomplished by the following constitution:

1. a silver halide photographic light sensitive material comprising a support having thereon a yellow dye image forming layer, a magenta dye image forming layer and a cyan dye image forming layer, wherein when the photographic material is subjected to exposure of not more than $10^{-6}$ sec. per pixel element and further to color developing to form yellow, magenta and cyan images, a variation at multiple exposure, based on non-multiple exposure, of an average gradation, which is a slope that connects two pints corresponding to densities of 0.5 and 1.5 on a characteristic curve of each of the yellow, magenta and cyan images, is not more than 10%;

2. the photographic material described in 1 above, wherein the photographic material satisfies the following requirements (1) and (2):

$$|\gamma m(Y)/\gamma m(M)-\gamma s(Y)/\gamma s(M)|\leqq 0.2 \quad (1)$$

$$|\gamma m(C)/\gamma m(M)-\gamma s(C)/\gamma s(M)|\leqq 0.15 \quad (2)$$

wherein γm(Y), γm(M) and γm(C) represent an average gradation at multiple exposure of yellow, magenta and cyan images, respectively; γs(Y), γs(M) and γs(C) represent an average gradation at non-multiple exposure of yellow, magenta and cyan images, respectively;

3. the photographic material described in 1 above, wherein the photographic material satisfies the following requirements (3) and (4):

$$|Dl(Y)/D1(M)-Ds(Y)/Ds(M)|\leqq 0.5 \quad (3)$$

$$|Dl(C)/D1(M)-Ds(C)/Ds(M)|\leqq 0.5 \quad (4)$$

wherein Dl(Y), Dl(M) and Dl(C) represent a reflection density of a square portion with an area of (beam diameter× 1000)2, obtained when subjected to scanning exposure in the maximum exposure amount and at 25% of overlap between light beam rasters with respect to yellow, magenta and cyan images, respectively, and Ds(Y), Ds(M) and Ds(C) represent a reflection density of a square portion with an area of (beam diameter×2)2 when subjected to scanning exposure in the maximum exposure amount and at 25% of overlap between light beam rasters with respect to yellow, magenta and cyan images, respectively;

4. the photographic material described in any of 1 to 3, wherein the yellow dye image forming layer, magenta dye image forming layer and cyan dye image forming layer each comprises light sensitive silver halide grains having a chloride content of not less than 95 mol %;

5. An image forming method comprising:
   subjecting the photographic material as described in any of 1 to 4 above to scanning exposure with a light beam modulated based on image information for an exposure time of not more than $10^{-6}$ sec per pixel and then
   subjecting the exposed photographic material to color processing; and 6. the method described in 5 above, wherein the total time from completion of exposure and to start of color processing is not more than 30 sec.

EXPLANATION OF NUMERALS

Figure 1:
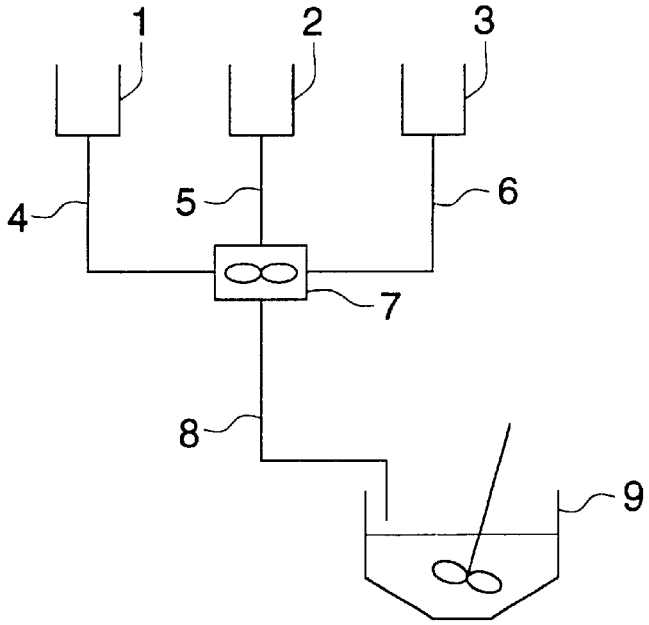
FIGS. 1 and 2 are schematic illustrations of an apparatus for preparing silver halide emulsions

1; Vessel (used for an aqueous silver nitrate solution),
2; Vessel (used for an aqueous dispersion medium, solution containing gelatin),
3; Vessel (used for an aqueous alkali halide solution)
4, 5 and 6; Addition line,
7; Mixer,
8; Line
9; Reaction vessel and
10; Ultrafiltration module.

DETAILED DESCRIPTION OF THE INVENTION

Multiple exposure of not more than $10^{-6}$ sec. means that exposure for an exposing duration of not more than $10^{-6}$ sec. per pixel is repeated two or more times. The average gradation at the multiple exposure can be determined as follows. Using a Xe flash light source with an emission time of not more than $10^{-6}$ sec., a photographic material is exposed twice at an interval of 10 sec or more, through an optical wedge and a color filter, and processed to obtain images. The thus obtained image characteristic value is close to characteristics of images obtained when subjected to scanning exposure with a light beam at 10 to 60% of overlap between light beam rasters (e.g., sub-scanning pitch is so adjusted that overlap between rasters is 10 to 60%). Thus, it is closely associated with image quality of images obtained through scanning exposure with light beams.

In cases when image information is digitized, it is common that an original image is divided into fine cells and the density information of each cell is digitized. When the original image is divided into fine cells, the minimum unit thereof is defined as a picture element (or pixel). Accordingly, exposure time per pixel is time which controls the intensity or irradiation time of the light beam, based on the digital date per pixel.

In the invention, the diameter of the light beam (or beam diameter) is defined as its raster width. Herein, the beam diameter is a diameter of light beam for which the light beam intensity has $1/e^2$ (or $e^{-2}$) of its maximum value. The beam diameter can be determined, for example, using a beam monitor having a combination of a slit and a power meter.

In general, scanning exposure with light beam is conducted by a combination of linear exposure with a light beam (i.e., raster exposure or main scanning) and shifting a photographic material in the direction perpendicular to the linear exposure (i.e., sub-scanning). There are employed, for example, a system (drum system), in which a photographic material is fixed onto the outside or inside periphery of a cylindrical drum, and the main scanning is performed by rotating the drum with irradiating light beam and the sub-scanning is concurrently performed by shifting the light source perpendicular to the rotating direction of the drum; and a system (a polygon system), in which a light beam is irradiated onto a polygon mirror and the reflected beam is allowed to scan horizontally to the rotating direction of the polygon mirror (main scanning) and a photographic material is concurrently allowed to move vertically to the rotating direction of the polygon mirror to perform the subscanning. In the drum system, the main scanning speed can be controlled by adjusting the diameter or the rotating speed of the drum and the subscanning speed can be controlled by adjusting the shift speed of a light source. In the polygon system, the main scanning speed can be controlled by adjusting the size, face number or rotating speed of the polygon mirror and the sub-scanning can be controlled by adjusting the transport speed of the photographic material.

The light beam overlap between rasters can optimally be controlled by adjusting timing of the main scanning speed and the sub-scanning speed. In cases when an exposure head having arrayed light sources is employed, overlap between rasters can be controlled by optimally adjusting spacings between the light sources.

As light sources usable in the invention are employed those known in the art, including a light emission diode (LED), a gas laser, a semiconductor laser (LD), a combination of an LD or solid laser using LD as an exciting light source, and secondary harmonic generator element (so-called SHG element), a combination of a halogen lamp and a PLZT element and a combination of a VFPH element and a color filter.

In the invention, the variation of the average gradation at multiple exposure, based on non-multiple exposure, which is denoted as $\Delta\gamma$, is represented by the following formula (A):

$$\Delta\gamma=|\gamma m-\gamma s|/\gamma s\times 100(\%) \quad (A)$$

where $\gamma m$ represents an average gradation at multiple exposure and obtained when the photographic material is subjected to multiple exposure of not more than $10^{-6}$ sec. per pixel; and $\gamma s$ represents an average gradation at non-multiple exposure and obtained when the photographic material is subjected to non-multiple (or single) exposure of not more than $10^{-6}$ sec. per pixel.

The average gradation at multiple exposure ($\gamma m$) or at non-multiple exposure ($\gamma s$) is defined as a slope of a straight line that connects two points corresponding to reflection densities of 0.5 and 1.5 on a characteristic curve of any one of the dye image forming layers. The average gradation as defined above can be determined from images obtained by subjecting the photographic material to exposure so as to dye-form only in a single dye image forming layer and processing. Thus, $\gamma m(Y)$ and $\gamma s(Y)$ are determined based on the reflection density obtained by subjecting the photographic material to exposure so as to cause it to form yellow dye only in the yellow image forming layer and which is measured with blue light. Similarly, $\gamma m(M)$ and $\gamma s(M)$ are determined based on the reflection density obtained by subjecting the photographic material to exposure so as to cause it to form magenta dye only in the magenta image forming layer and which is measured with green light; and $\gamma m(C)$ and $\gamma s(C)$ are determined based on reflection density obtained by subjecting the photographic material to exposure so as to cause it to form cyan dye only in a cyan image forming layer and which measured with red light. In formula (A) described above, $\gamma m$ and $\gamma s$ represent an average gradation of any one of the yellow, magenta and cyan image forming layers. The expression "subjecting the photographic material to exposure so as to form a dye only in the dye image forming layer" means exposing the photographic material to light so that dye images are formed substantially only in the single image forming layer, therefore, a fog density produced in other unexposed layer(s) and a slight color stain due to cross-layer diffusion of an oxidation product of a developing agent are neglected.

The average gradation at multiple exposure ($\gamma m$) or at non-multiple exposure ($\gamma s$) can be determined according to the following procedure: using a Xe flash light source with an emission time of not more than $10^{-6}$ sec., a photographic material is exposed through an optical wedge and a color separation filter, once in case of non-multiple exposure or twice at an interval of 10 sec or more in case of multiple exposure, then, developed with the following color developer (CDC-1) at a temperature of 37+0.5° C. for a period of 45 sec. and further subjected to conventional bleach-fixing and washing or stabilizing. The thus obtained yellow, magenta and cyan images each are sensitometrically measured with respect to the status A reflection density.

| | |
|---|---|
| Water | 800 ml |
| Triethylenediamine | 2 g |
| Diethylene glycol | 10 g |

-continued

| | |
|---|---|
| Potassium bromide | 0.02 g |
| Potassium chloride | 4.5 g |
| Potassium sulfite | 0.25 g |
| N-ethyl-N-(β-methanesulfonamidoethyl)-methyl-4-aminoaniline sulfate | 4.0 g |
| N,N-diethylhydroxyamine | 5.6 g |
| Triethanol amine | 10.0 g |
| Sodium diethylenetriaminepentaacetate | 2.0 g |
| Potassium carbonate | 30 g |

Water is further added to make 1 liter and the pH is adjusted to 10.1 with sulfuric acid or potassium hydroxide.

When Dl and Ds satisfy requirements (3) and (4) above-described as desired, advantageous effects of the invention are enhanced. In this case, Dl represents the reflection density of a square portion with an area of (beam diameter×1000)2 when subjected to scanning exposure in the maximum exposure amount and at 25% of overlap between beam light rasters, and Ds represents the reflection density of a square portion with an area of (beam diameter×2)2 when subjected to scanning exposure in the maximum exposure amount and at 25% of overlap between beam light rasters. The maximum exposure amount refers to a maximum value within a range of exposure modulated in accordance with image data.

In requirements (3) and (4), Dl(Y) and Ds(Y) represent the yellow reflection density obtained by subjecting the photographic material to scanning exposure so as to cause it to form yellow dye only in the yellow image forming layer and which is measured with blue light. Similarly, Dl(M) and Ds(M) represent the reflection magenta density obtained by subjecting the photographic material to exposure so as to cause it to form magenta dye only in the magenta image forming layer and which is measured with green light; and Dl(C) and Ds(C) represent the cyan reflection density obtained by subjecting the photographic material to exposure so as to cause it to form cyan dye only in the cyan image forming layer and measured with red light.

Color development is carried out using the color developer (CDC-1) described above. The reflection density is measured by using a microdensitometer (e.g., PDM-5AR, available from Konica Corp.), with which the reflection density of minute area portions can be measured.

One preferred embodiment of the invention is that in a microdensitometer measurement curve of a magenta fine line image obtained when the photographic material is subjected to scanning exposure for an exposing duration of not more than $10^{-6}$ sec per pixel., based on image data of a fine line having a width of one pixel by use of a scanning exposure apparatus and further subjected to color developing, the ratio of toe-width to half-width is from 1.2 to 3.0. The toe-width and half-width can be determined in the following manner. Densitometry of the magenta fine line image obtained as above is conducted in the direction perpendicular to the fine line by use of a microdensitometer by scanning with an aperture size of 500 μm in length (parallel to the fine line) and 5 μm in width (in the scanning direction) and a sampling pitch of 1 μm. Toe-width is defined as the distance between two points corresponding to a value of the minimum density plus 0.06× (maximum density−minimum density) on the density curve (i.e., a fine line profile) obtained by plotting a density for every scanning point against the scanning position. Half-width is defined as a distance between two points corresponding to a value of (maximum density−minimum density)/2. The ratio of toe-width to half width is preferably 1.2 to 3.0, and more preferably 1.5 to 2.5.

There can be employed various means for obtaining silver halide photographic materials meeting the requirements described above, including control of silver halide grain forming processes, control of chemical sensitization processes and control of coating solution compositions. Specifically effective is a method for optimally controlling the kind, amount and ligands of heavy metal ions used in silver halide grain formation and a method for controlling the addition timing and amount of mercapto group containing inhibitors.

In the image forming process according to this invention, the time after completing the scanning exposure described above and before starting color development is optional. However, when exposed to high intensity light for a short period of not more than $10^{-6}$ sec per pixel, formed latent images are supposed to tend to be unstable. Specifically, in cases where the time from completion of exposure to start of development is not more than 30 sec., doubling of super-fine lines tended to occur at the time of scanning exposure, along with variations in gradation. In such cases, the present invention is specifically effective.

Any kind of silver halide is usable in photographic materials according to the invention. Silver bromochloride, silver iodochlorobromide, silver iodochloride, silver chloride, silver bromide and silver iodobromide can be used alone of in combination. Specifically, in cases where silver halide incorporated in each color image forming layer contains chloride of not less than 95 mol %, latent images formed through high intensity, over a short period exposure are supposed to tend to be unstable with a decrease of interstitial silver ions, resulting in color doubling in the super-fine line images. The present invention is specifically effective in such cases.

Silver halide grains containing high bromide phase within the grain are preferably used in photographic materials used in the invention. In this case, the high bromide phase may be in the form of a layer, such as in core/shell type grains or in the form of a partial region different in composition, so-called epitaxial junction. The composition may vary continuously or discontinuously. The high bromide phase is localized preferably in the corner of silver halide grains.

In silver halide emulsions used in the invention is employed a chemical sensitizing method using gold compounds or sensitizing method using a chalcogen compounds alone or in combination. Examples of the chalcogen compounds include sulfur sensitizers, selenium sensitizers and tellurium sensitizers. Of these are preferred sulfur sensitizers, including thiosulfates, allylthiocarbamate, thioureas, allylisothiacyanate, cystein, p-toluenethiosulfates, rhodanine and a simple substance of sulfur. Gold sensitizers include chloroauric acid, gold sulfide and various gold complexes. Preferred and exemplary ligand compounds used in the gold complex include dimethyl rhodanine, thiocyanic acid, mercaptotetrazole and mercaptotriazole. The chemical sensitizer is preferably employed in an amount of not more than $1\times10^{-4}$ mol per mol of silver halide, and more preferably not more than $1\times10^{-5}$ mol per mol of silver halide.

It was also proved to be important in the invention that chemical sensitization nuclei were homogeneously and optimally dispersed and the chalcogen sensitizer and gold sensitizer were used in a given ratio thereof. Furthermore, a method for incorporating the chemical sensitizer is an important technique. Exemplarily, all of the chemical sensitizer is not instantaneously added at a time but it is rather separately or continuously added. Details of the mechanism has not been elucidated but according to this method, it is supposed to avoid that when a lot of the chemical sensitizer is supplied to a silver halide emulsion at a time during chemical sensitization, inhomogeneity in the concentration of the sensitizer in the emulsion is resulted in, leading to fluctuation in sensitizing effects on silver halide grains. Accordingly, a sensitizer is continuously or intermittently added over a period of at least 10%, and more preferable at least 50% of the chemical sensitizing time. In cases when continuously added, the sensitizer may be added at a constant rate or at an accelerated rate. In cases when intermittently added, the addition interval is preferably at least 10%, and more preferably at least 50% of the total ripening time, and each addition amount may be the same or different. According to the invention it is also preferred to employ desensitizing dyes in which a sum of polarographic anode and cathode potentials is positive. Preferred examples thereof are described in JP-B 36-17595, 39-20261, 40-26751, 43-13167, 45-8833, 47-8746 and 50-37530 (herein the term, JP-B means examined, published Japanese Patent); and U.S. Pat. Nos. 2,271,458, 2,541,472, 3,035,917, 3,062,651 and 3,3,124,458. The desensitizing dye is added preferably in an amount of nor more than 10 mg, and more preferably not more than 5 mg per mol of silver halide. The desensitizing dye may added at any time during the course of forming a silver halide emulsion and is preferably added at the time of completion of chemical ripening in terms of high intensity exposure characteristics as well as sensitivity and gradation.

High chloride silver halide grains, which contain a high bromide-localized phase on the grain surface (preferably at the corner or edge of the grain), are preferably employed in the invention. Such silver halide grain emulsions, which can be prepared by using fine grains different in composition from host grains or containing a metal complex, are effective technique for providing a high contrast photographic material. Although there is known a technique of adding fine grains to provide a new function to the host grain, there is also preferably employed in the invention a technique in which at the stage after forming silver halide grains and before coating, fine grains are formed in a mixing vessel provided outside of a reaction vessel for chemically ripening the silver halide grains and formed fine grains are immediately mixed with the silver halide grain emulsion, preferably using an apparat us as shown in FIG. 1. Thereby, finer grains can be added to the reaction vessel, enhancing dissolution of the fine grains and leading to fixed metal doping position and effective formation of high bromide silver halide phase.

Figure 2:
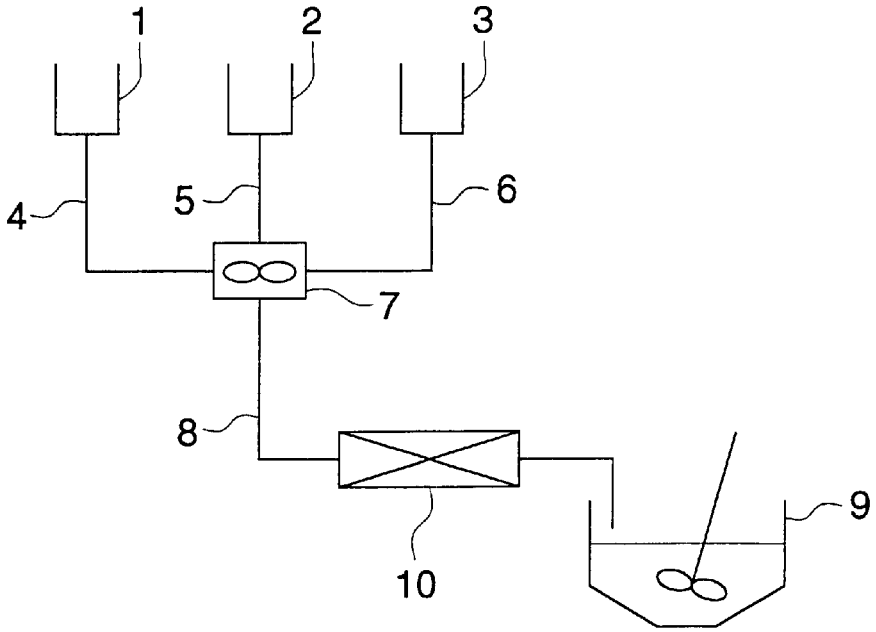

Thus, as shown in FIG. 1, an aqueous silver nitrate solution, an aqueous dispersing medium solution containing gelatin and an aqueous alkali halide solution are added into vessels 1, 2 and 3, respectively; and each of them is introduced, through adding lines 4, 5 and 6, into mixing vessel 7, in which a fine grain emulsion is formed with stirring at a high speed and immediately supplied, through adding line 8, to reaction vessel 9 containing a silver halide emulsion. During the course of from the mixer (7) to the reaction vessel (9) is preferably included the stage for removing a part of water and aqueous soluble compounds. As a removing method, ultrafiltration or electrodialysis is optionally employed and ultrafiltration is preferably employed, and specifically, a ultrafiltration apparatus internally having a hollow membrane. As shown in FIG. 2, for example, a fine grain emulsion formed in the mixer (7) is supplied to the reaction mixer through addition line 8 and ultrafiltration module 10. The fine grain size is preferably not more than 0.15 $\mu$m, and more preferably not more than 0.1 $\mu$m. The fine grains preferably contain at least one of the 8th group metals, such as iron, cobalt, ruthenium, rhodium, osmium, nickel, palladium and iridium. Specifically, iridium compounds are preferably employed. As a ligand are preferably employed halide ions such as chloride bromide ions, cyanide ion, carbonyl and nitrosyl. An iridium compound is contained preferably in an amount of $10^{-9}$ to $10^{-5}$ mol, and more preferably $10^{-8}$ to $10^{-6}$ mol per mol of silver halide. The fine grains are preferably bromide containing grains, and the bromide content is 0.1 to 3.0 mol %, and more preferably 0.4 to 2.0 mol % per mol of final silver halide grains.

In order to obtain the silver halide emulsion according to the present invention, heavy metal ions are advantageously incorporated. These compounds prevent effectively a sharp inflection of a characteristic curve caused by a high intensity, short time exposure. Heavy metal ions which can be employed for this purpose can include an ion of each of the Groups 8 to 10 metals such as iron, iridium, platinum, palladium, nickel, rhodium, osmium, ruthenium, cobalt, etc. and the Group 12 metals such as cadmium, zinc, mercury, etc. and lead, rhenium, molybdenum, tungsten, gallium, chromium. Of them, any ion of iron, iridium, platinum, ruthenium, gallium, osmium is preferable.

Any of these ions can be added to the silver halide emulsion in the form of a salt or complex.

When the aforementioned heavy metal ion forms a complex, preferred examples of the ligands include a cyanide ion, a thiocyanate ion, an isothiocyanate ion, a cyanate ion, a chloride ion, a bromide ion, an iodide ion, carbonyl,-ammonia, etc. Of those, the cyanide ion, the thiocyanate ion, the isocyanate ion, the chloride ion and the bromide ion, etc.

To allow a heavy metal ion to be occluded within the silver halide emulsion grains according to the present invention, the addition of the corresponding heavy metal compound may be optionally conducted at any point of each process before forming silver halide grains, during forming silver halide grains and during physical ripening after forming silver halide grains. In order to prepare the silver halide emulsion which meets the aforementioned conditions, the heavy metal compound is dissolved together with halide salts and the resulting solution can be continuously added during whole or part of a grain forming process.

The addition amount of the heavy metal ion in the silver halide emulsion is preferably not less than $1\times10^{-9}$ mole and not more than $1\times10^{-2}$ mole per 1 mole of silver halide, and more preferably not less than $1\times10^{-8}$ mole and not more than $5\times10^{-5}$ mole per 1 mole of silver halide.

Any shape of the silver halide grains according to the present invention can be optionally employed. One of preferred examples is a cube having (100) facets as crystal surfaces. Furthermore, grains having the shape of octahedron, tetradecahedron, dodecahedron, etc. are prepared according to methods described in U.S. Pat. Nos. 4,183,756, 4,225,666, Japanese Patent Publication Open to Public Inspection No. 55-26589, Japanese Patent Publication No. 55-42737 and in Journal Photographic Science, Vol. 21, p. 39 (1973), etc., and are employed. Furthermore, grains having twinning faces may be employed.

As the silver halide grains according to the present invention, grains having the sane shape are preferably employed. In addition, two or more of monodispersed silver halide emulsions are preferably added to the same layer.

The size of silver halide grains used in the invention is not specifically limited, but taking account of rapid processability, sensitivity and other photographic characteristics, the grain size is preferably 0.1 to 1.2 $\mu$m, and more preferably 0.2 to 1.0 $\mu$m. The grain size can be represented in terms of the grain projected area or diameter approximation value. In cases where grains are substantially uniform, the grain size distribution can be represented in terms of the grain diameter or projected area. Monodisperse silver halide grains having a variation coefficient of grain size of 0.05 to 0.22, and more preferably 0.05 to 0.15 are preferred. At least two kinds of monodisperse emulsions are preferably contained in the same layer. The variation coefficient is a parameter representing the width of grain size distribution, represented by the following equation:

$$\text{Variation Coefficient}=S/R$$

where S is a standard deviation of grain size distribution; and R is a average grain size. The grain size is to be a diameter in cases of spherical grains, and in cases of cube or forms other than sphere, it is to be a diameter of a circle having the same area as the projected area.

Apparatuses for preparing the silver halide emulsion and the preparation methods known in the art in the photographic industry can be employed.

The silver halide emulsion according to the present invention can be prepared employing any of an acid method, a neutral method or an ammonia method. The grains can be grown at one time and can be grown after preparing seed grains. The method for preparing the seed grains and the method for growing grains can be the same or different.

Furthermore, as methods for reacting soluble silver salts with soluble halide salts, any of a normal mixing method, a reverse mixing method, a double jet method or combination thereby can be employed. However, the double jet method is preferably employed. Further, a pAg controlled double jet method can be employed which is described as one of the simultaneous mixing methods in Japanese Patent Publication Open to Public Inspection No. 54-48521.

Furthermore, apparatuses can be employed described in Japanese Patent Publication Open to Public Inspection Nos. 57-92523, 57-92524, etc. wherein an aqueous water-soluble silver salt solution and an aqueous halide salt solution are supplied from addition devices arranged in a reaction mother solution, described in German Patent Open to Public Inspection No. 2,921,164, etc. wherein an aqueous water-soluble silver salt solution and an aqueous halide salt solution are added while changing continuously the concentration, described in Japanese Patent Publication No. 56-501776 wherein a reaction mother solution is taken out of a reactor and by increasing the concentration using an ultrafiltration method, grains are grown while holding distances between silver halide grains constant. Furthermore, silver halide-dissolving solvents such as thioether, etc. can be employed, if desired. In addition, compounds having a mercapto group, nitrogen containing heterocyclic compounds or compounds such as spectral sensitizers can be added during the formation of sliver halide grains or after the grain formation.

Silver halide emulsions used in the invention may be sensitized by the reduction sensitization method.

An antifoggant or a stabilizer known in the art are incorporated into the photographic material, for the purpose of preventing fog produced during the process of preparing the photographic material, reducing variation of photographic performance during storage or preventing fog produced in development. Examples of preferred compounds for the purpose include compounds represented by formula (II) described in JP-A 2-146036 at page 7, lower column, such as compounds IIa-1 to IIa-8, IIb-1-1 to IIb-7 described in page 8, and 1-(3-methoxyphenyl)-5-mercaptotetrazole and 1-(4-ethoxyphenyl)-5-mercaptotetrazole. These compounds are added in the step of preparing a silver halide emulsion, the chemical sensitization step or the course of from completion of chemical sensitization to preparation of a coating solution. These compounds each are employed in chemical sensitization preferably in an amount of $1\times10^{-5}$ to $1\times10^{-4}$ mol per mol of silver halide. In cases when added at the time of completion of chemical sensitization, the compound is employed preferably in an amount of $1\times10^{-6}$ to $1\times10^{-2}$ mol, and more preferably $1\times10^{-5}$ to $5\times10^{-3}$ mol per mol of silver halide. In cases when added at the time of preparing a coating solution, the compound is employed preferably in an amount of $1\times10^{-6}$ to $1\times10^{-1}$ mol, and more preferably $1\times10^{-5}$ to $1\times10^{-2}$ mol per mol of silver halide. In cases when added to a layer other than a silver halide emulsion layer, the compound is employed preferably-in an amount of $1\times10^{-9}$ to $1\times10^{-3}$ mol per $m^2$.

As the silver halide grains according to the present invention, a so-called tabular silver halide is preferably employed in order to control the gradation balance. As the tabular grain containing the high concentration of silver chloride, a grain having (111) major faces and a grain having (100) major faces have been known. However, in view of the stability of the grain shape, the grain having the (100) major faces is preferably employed. Incorporation of the tabular grain into the photographic materials used in the invention advantageously shorten the bleaching time.

The total amount of light-sensitive silver halide contained in the photographic material relating to the invention is preferably not more than 0.7 g/m2, based on equivalent converted to silver. In such cases, desilvering is readily performed, development of the lower-most layer is less influenced by that of the upper layer, leading to stable image reproduction in printing.

As couplers employed in the light-sensitive material according to the present invention, can be employed any compounds which can form a coupling product (e.g., a dye) having a spectral absorption maximum at the wavelengths of 340 nm or longer upon coupling with an oxidized color developing agent. Particularly, representative compounds include a yellow dye forming coupler having a spectral absorption maximum at the wavelengths in the region of 350 to 500 nm, magenta dye forming coupler having a spectral absorption maximum at the wavelengths in the region of 500 to 600 nm and a cyan dye forming coupler having a maximum spectral absorption at the wavelengths in the region of 600 to 750 nm.

Examples of cyan couplers preferably used in the photographic material include couplers described in JP-A 4-114154, at page 5, left lower column and represented by formulas (C-I) and (C-II); couplers described in JP-A 2-235056, at page 4, left lower column and represented by formulas (Ia), (Ib) and (Ic); couplers described in JP-A 1-2247614, at page 7, right lower column to page 8, left upper column and represented by formulas (IIα) to (VIIIα), and at page 7, lower right column to page 8, left upper column and represented by formulas (IIβ) to (VIIIβ). Of these, the couplers represented by formulas (IIβ) to (VIIIα) and (IIβ) to (VIIIβ) are preferred in terms of the absorption of the dye being sharp and color reproduction being superior.

Examples of magenta couplers preferably usable in the photographic material employed in the invention include couplers represented by formula (M-I) of (M-II) described in JP-A 4-114154 at page 4, right upper column. Of these couplers are preferred those represented by formula (M-I). A coupler which has a tertiary alkyl group as RM of formula (M-I), is more preferable in terms of being superior in light fastness.

Examples of yellow couplers preferably used in the photographic material employed in the invention include couplers represented by formula (Y-I) described in JP-A 4-114154 at page 3, right upper column. A coupler which has an alkoxy group as RY1 of formula (Y-I), or couplers represented by formula [I] described in JP-A 6-67388 is preferable in terms of preferred reproduction of yellow tone. More preferred compounds are those represented by formula [Y-I] described in JP-A 4-81847 at pages 1 and 11 to 17.

In cases where using an oil-in-water type emulsion-dispersing method to incorporate a coupler or other organic compounds into a photographic material, a coupler is dissolved in a high boiling solvent, optionally in combination with a low boiling and/or water-soluble organic solvent, and further dispersed in a hydrophilic colloid such as a gelatin aqueous solution using a surfactant. The high boiling solvent used for dissolving and dispersing a coupler preferably has a dielectric constant of 3.5 to 7.0. Two or more high boiling solvents can be employed in combination.

As a surfactant used for dispersing a photographic adjuvant or adjusting surface tension at the time of coating are preferably employed compounds having a hydrophobic group with 8 to 30 carbon atoms and a sulfonic acid group or its salt. A surfactant, an alkyl group of which is fluorine-substituted, is also preferably employed. The dispersing solution is conventionally added into a coating solution containing a silver halide emulsion. A period of time until added into the coating solution after dispersing, or until coated after adding into the coating solution is the shorter, is the more preferable. It is preferably within 10 hrs. more preferably 3 hrs. and furthermore preferably 20 min.

The above-described couplers are preferably used in combination with an anti-fading agent to prevent fading of the dye image due to light, heat or humidity. Preferred compounds for magenta dyes include phenyl ether compounds represented by formula I or II described in JP-A 2-66541 at page 3; phenol compounds represented by formula IIIB described in JP-A 3-174150; amine compounds represented by formula A described in JP-A 64-90445; metal complex compounds represented by formula XII, XIII, XIV and XV described in JP-A 62-182741 Compounds represented by formula I' described in JP-A 1-196049 and compounds represented by formula II described in JP-A 5-11417 are preferred for yellow or cyan dyes.

A compound (d-11) described in JP-A 4-114154 at page 9, left lower column and a compound (A'-1) described in the same at page 10, left lower column are also employed for allowing the absorption wavelengths of a dye to shift. Besides can also be employed a compound capable of releasing a fluorescent dye described in U.S. Pat. No. 4,774,187.

A compound capable of reacting with an oxidized developing agent is preferably incorporated into a layer between light sensitive layers to prevent color stain or into a silver halide emulsion layer to improve fogging. For the purpose thereof are preferably employed hydroquinone derivatives and more preferably dialkylhydroquinones such as 2,5-di-t-octylhydroquinone.

A UV absorbent is preferably incorporated into the photographic material to prevent static fogging or improve light fastness of dye images. Examples of preferred UV absorbents include benzotriazoles, more preferably, a compound represented by formula III-3 described in JP-A 1-250944, a compound represented by formula III described in JP-A 64-66646, compounds, UV-1L to UV-27L described in JP-A 63-187240, a compound represented by formula I described in JP-A 4-1633 and a compound represented by formula (I) or (II) described in JP-A 5-165144.

There are employed dyes having absorption at various wavelengths for anti-irradiation and anti-halation in the photographic material relating to the invention. A variety of dyes known in the art can be employed, including dyes having absorption in the visible range described in JP-A 3-251840 at page 308, AI-1 to 11, and JP-A 6-3770; infra-red absorbing dyes described in JP-A 1-280750 at page 2, left lower column, formula (I), (II) and (III).

Fluorescent brightening agents are also incorporated into the photographic material to improve whiteness. Examples of preferred compounds include those represented by formula II described in JP-A 2-232652.

The photographic material used in the invention comprises layer(s) containing silver halide emulsion(s) which are spectrally sensitized in the wavelength region of 400 to 900 nm, in combination with a yellow coupler, a magenta coupler and a cyan coupler. The silver halide emulsion contains one or more kinds of sensitizing dyes, singly or in combination thereof. In the silver halide emulsions used in the invention can be employed a variety of spectral-sensitizing dyes known in the art. Compounds BS-1 to 8 described in JP-A 3-251840 at page 28 are preferably employed as a blue-sensitive sensitizing dye. Compounds GS-1 to 5 described in JP-A 3-251840 at page 28 are preferably employed as a green-sensitive sensitizing dye. Compounds RS-1 to 8 described in JP-A 3-251840 at page 29 are preferably employed as a red-sensitive sensitizing dye. In cases where exposed to infra-red ray with a semiconductor laser, infrared-sensitive sensitizing dyes are employed. Compounds IRS-1 to 11 described in JP-A 4-285950 at pages 6-8 are preferably employed as a blue-sensitive sensitizing dye. Supersensitizers SS-1 to SS-9 described in JP-A 4-285950 at pages 8-9 and compounds S-1 to S-17 described in JP-A 5-66515 at pages 5-17 are preferably included, in combination with these blue-sensitive, green-sensitive and red-sensitive sensitizing dyes.

The sensitizing dye is added at any time during the course of silver halide grain formation to completion of chemical sensitization. The sensitizing dye is incorporated through solution in water-miscible organic solvents such as methanol, ethanol, fluorinated alcohol, acetone and dimethylformamide or water, or in the form of a solid particle dispersion.

In the photographic materials used in the invention is advantageously employed gelatin as a binder. Furthermore, there can be optionally employed other hydrophilic colloidal materials, such as gelatin derivatives, graft polymers of gelatin with other polymers, proteins other than gelatin, saccharide derivatives, cellulose derivatives and synthetic hydrophilic polymeric materials. A vinylsulfone type hardening agent or a chlorotriazine type hardening agent is employed as a hardener of the binder, and compounds described in JP-A 61-249054 and 61-245153 are preferably employed. An antiseptic or antimold described in JP-A 3-157646 is preferably incorporated into a hydrophilic colloid layer to prevent the propagation of bacteria and mold which adversely affect photographic performance and storage stability of images. A lubricant or a matting agent is also preferably incorporated into a protective layer to improve surface physical properties of raw or processed photographic materials, as described in JP-A 6-118543 and 2-73250.

A variety of supports are employed in the photographic material used in the invention, including paper coated with polyethylene or polyethylene terephthalate, paper support made from natural pulp or synthetic pulp, polyvinyl chloride sheet, polypropylene or polyethylene terephthalate supports which may contain a white pigment, and baryta paper. Of these supports a paper support coated, on both sides, with water-proof resin layer. As the water-proof resin are preferably employed polyethylene, ethylene terephthalate and a copolymer thereof. Inorganic and/or organic white pigments are employed, and inorganic white pigments are preferably employed. Supports having a center face roughness (SRa) of 0.15 nm or less (preferably, 0.12 nm or less) are preferably employed in terms of glossiness. Trace amounts of a blueing agent or reddening agent such as ultramarine or oil-soluble dyes are incorporated in a water-proof resin layer containing a white pigment or hydrophilic layer(s) of a reflection support to adjust the balance of spectral reflection density in a white portion of processed materials and improve its whiteness. The surface of the support may be optionally subjected to corona discharge, UV light exposure or flame treatment and further thereon, directly or through a sublayer (i.e., one or more sublayer for making improvements in surface properties of the support, such as adhesion property, antistatic property, dimensional stability, friction resistance, hardness, anti halation and/or other characteristics), are coated component layers of the photographic material relating to the invention. In coating of the photographic material, a thickening agent may be employed to enhance coatability of a coating solution. As a coating method are useful extrusion coating and curtain coating, in which two or more layers are simultaneously coated.

The image forming method according to the invention is preferably applied to photographic materials used for forming a directly observable image, including a color print paper, color reversal paper, direct positive material, display photographic material and a photographic material used for color proof. Specifically, the image forming method is preferably applied to photographic materials having a reflection support.

Employed as an aromatic primary amine developing agent used in the invention are compounds known in the art. Examples of the aromatic primary amine developing agents include N,N-diethyl-p-phenylendiamine2-amino-5-diethylaminotoluene, 2-amino-5-(N-ethyl-N-laurylamino) toluene, 4-(N-ethyl-N-(β-hydroxyethyl)amino)-aniline, 2-methyl-4-(N-ethyl-N-(β-hydroxyethyl)amino)aniline, 4-amino-3-methyl-N-ethyl-N-(β-methanesulfoneamido)-ethyl)aniline, N-(2-amino-5-diethylaminophenylethyl)-methanesulfonamide, N,N-dimethyl-p-phenylenediamine, 4-amino-3-methyl-N-ethyl-N-metoxyethylaniline, 4-amino-3-methyl-N-ethyl-N-(β-ethoxyethyl)aniline, 4-amino-3-methyl-N-ethyl-N-(γ-hydroxypropyl)aniline, 4-amino-3-methyl-N-ethyl-N-(4-hydroxybutyl)aniline, 4-amino-3-methyl-N-ethyl-N-(β-hydroxypropyl)aniline, 4-amino-3-methyl-N-ethyl-N-(2-hydroxy(1-methyl)ethyl)aniline, 4-amino-3-ethyl-N-methyl-N-(γ-hydroxypropyl)aniline; and various aromatic primary amine developing agents described in JP-A 3-345142, 4-11255, 4-45440, 4-226452, and 4-371948. Besides the aromatic primary amine developing agents, sulfophenylhydrazine or carbonylhydrazine type developing agents are also preferably employed, as described in European Patent 565,165, 572,054 and 593,110, JP-A 8-202002, 8-227131 and 8-234390.

The color developing solution containing a color developing agent described above can be used at an appropriate pH, and the pH is preferably 9.5 to 13.0, and more preferably 9.8 to 12.0 in terms of rapid access. The color developing temperature relating to the invention is preferably 35 to 70° C. Higher temperature promote development, but the temperature range of 37 to 60° C. is specifically preferred in terms of process stability. The color developing time is preferably 45 sec. or less and more preferably 30 sec. or less.

In addition to the color developing agent, developer composing compounds known in the art can be incorporated in the developing solution. There are conventionally used an alkaline agent for pH-buffering, a development retarder such as chloride ion and benzotriazoles, preservatives and chelating agents. There is also preferred image formation through so-called heat-development, in which a color developing agent (or its precusor) or a compound capable of releasing a dye upon oxidation reduction reaction is allowed to be incorporated into a photographic material and development is proceeded by supplying a small amount of a reaction aid (such as water) or superposing a processing sheet, and then heating. Furthermore, amplified development is preferably conducted using a color developing agent in combination with an oxidizing agent.

In the image forming method according to the invention, photographic materials, after color-developed, may be optionally subjected to bleaching and fixing. The bleaching and fixing may be carried out currently. After fixing, washing is conventionally carried out. Stabilizing may be conducted in place of washing. As a processing apparatus used in the invention is applicable a roller transport type processor in which a photographic material is transported with being nipped by rollers and an endless belt type processor in which a photographic material is transported with being fixed in a belt. Further thereto are also employed a method in which a processing solution supplied to a slit-formed processing bath and a photographic material is transported therethrough, a spraying method, a web processing method by contact with a carrier impregnated with a processing solution and a method by use of viscous processing solution. In cases when large amounts of photographic materials are processed, continuous processing was run using an automatic processor. In this case, processing at a low reprenishing rate is preferred, and replenishment using solid processing composition in the form of a tablet or granule is more preferred, as disclosed in Technical Disclosure 94-16935. In thermal processing, bleaching and fixing can be conducted by allowing only image dyes to transfer to another sheet (dye receiving sheet).

EXAMPLES

The present invention will be further explained based on examples, but embodiments of the invention are not limited to these.

Example 1

Preparation of Red-sensitive Silver Halide Emulsion

To 1 liter of aqueous 2% gelatin solution kept at 40° C. were simultaneously added the following solutions (Solutions A and B) in 30 min., while being maintained at a pAg of 7.3 and pH of 3.0, and further thereto were added Solutions C and D in 180 min., while being maintained at a pAg of 8.0 and pH of 5.5. The pAg was controlled by the method described in JP-A 59-45437, and the pH was adjusted using aqueous sulfuric acid or sodium hydroxide solution.

| Solution A | |
|---|---|
| Sodium chloride | 3.42 g |
| Potassium bromide | 0.03 g |
| Water to make | 200 ml |

-continued

| Solution B | |
|---|---|
| Silver nitrate | 10 g |
| Water to make | 200 ml |
| Solution C | |
| Sodium chloride | 102.7 g |
| $K_2IrCl_6$ | $4 \times 10^{-8}$ mol |
| $K_4Fe(CN)_6$ | $2 \times 10^{-5}$ mol |
| Potassium bromide | 1.0 g |
| Water to make | 600 ml |
| Solution D | |
| Silver nitrate | 300 g |
| Water to make | 600 ml |

After completing the addition, the resulting emulsion was desalted using a 5% aqueous solution of Demol N (produced by Kao-Atlas) and aqueous 20% magnesium sulfate solution, and redispersed in a gelatin aqueous solution to obtain a monodisperse cubic grain emulsion (EMP-1) having an average grain size of 0.40 $\mu$m, a coefficient of variation of grain size of 0.07 and a chloride content of 99.5 mol %. Further, a monodisperse cubic grain emulsion (EMP-1B) having an average grain size of 0.38 $\mu$m, a coefficient of variation of grain size of 0.07 and a chloride content of 99.5 mol % was prepared in the same manner as in preparation of EMP-1, except that an adding time of Solutions A and B, and that of C and D were respectively varied.

The emulsion, EMP-1 was chemically sensitized at 60° C. using the following compounds. The emulsion, EMP-1B was also optimally chemical-sensitized in a similar manner, and then sensitized EMP-1 and EMP-1B were blended in a ratio of 1:1 based on the silver amount to obtain a red-sensitive silver halide emulsion (101R).

| | |
|---|---|
| Sodium thiosulfate | $1 \times 10^{-4}$ mol/mol AgX |
| Chloroauric acid | $1.2 \times 10^{-4}$ mol/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |
| Sensitizing dye RS-1 | $1 \times 10^{-4}$ mol/mol AgX |
| Sensitizing dye RS-2 | $1 \times 10^{-4}$ mol/mol AgX |

STAB-1: 1-(3-Acetoaminophenyl)-5-mercaptotetrazole
STAB-2: 1-Phenyl-5-mercaptotetrazole
STAB-3: 1-(4-Ethoxyphenyl)-5-mercaptotetrazole To the red-sensitive emulsion ws added $2.0 \times 10^{-3}$ mol/mol AgX of SS-1.

RS-1

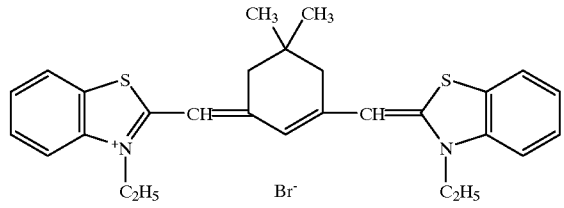

-continued

RS-2

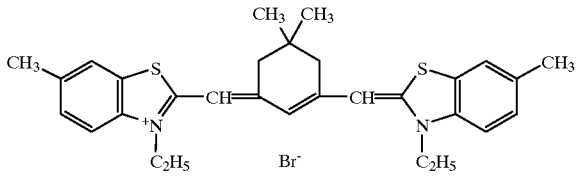

SS-1

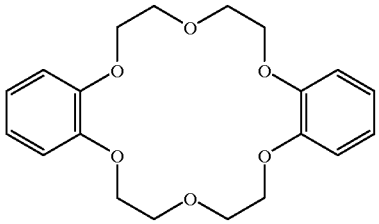

Emulsion (102R) was prepared in the same manner as Emulsion (101R), except that sodium thiosulfate to be added was equally divided into two parts and at 10 min. after addition of one part, the other part was added.

Emulsion (103R) was prepared in the same manner as Emulsion (102R), except that the addition interval of the two equal parts was 60 min.

Emulsion (104R) was prepared in the same manner as Emulsion (102R), except that the addition interval of two equal parts was 100 min.

Emulsion (105R) was prepared in the same manner as Emulsion (102R), except that the addition interval of two equal parts was 200 min.

Emulsion (106R) was prepared in the same manner as Emulsion (102R), except that sodium thiosulfate was continuously added at a constant flow rate over a period of 200 min. of chemical ripening.

Emulsion (107R) was prepared in the same manner as Emulsion (101R), except that chloroauric acid to be added was equally divided into two parts and at 10 min. after addition of one part, the other part was added.

Emulsion (108R) was prepared in the same manner as Emulsion (107R), except that the addition interval was 60 min.

Emulsion (109R) was prepared in the same manner as Emulsion (107R), except that the addition interval was 100 min.

Emulsion (110R) was prepared in the same manner as Emulsion (107R), except that the addition interval was 200 min.

Emulsion (111R) was prepared in the same manner as Emulsion (101R), except that chloroauric acid was continuously added at a constant flow rate over a period of 200 min. of chemical ripening.

Preparation of Green-sensitive Silver Halide Emulsion

Monodisperse cubic grain emulsions, EMP-2 having an average grain size of 0.40 $\mu$m, a variation coefficient of 0.08 and a chloride content of 99.5 mol % and EMP-2B having an average grain size of 0.50 $\mu$m, a variation coefficient of 0.08 and a chloride content of 99.5 mol % each were prepared in the same manner as in preparation of EMP-1, except that an adding time of Solutions A and B, and that of Solution C and D were respectively varied.

The emulsion, EMP-2 was optimally chemical-sensitized at 55° C. using the following compounds. The emulsion, EMP-2B was also optimally chemical-sensitized in a similar manner, and then sensitized EMP-2 and EMP-2B emulsions were blended in a ratio of 1:1 based on the silver amount to obtain a green-sensitive silver halide emulsion (101G).

| | |
|---|---|
| Sodium thiosulfate | $1 \times 10^{-4}$ mol/mol AgX |
| Chloroauric acid | $1.2 \times 10^{-4}$ mol/mol AgX |
| Stabilizer STAB-1 | $2.5 \times 10^{-4}$ mol/mol AgX |
| Stabilizer STAB-2 | $3.1 \times 10^{-4}$ mol/mol AgX |
| Stabilizer STAB-3 | $3.1 \times 10^{-4}$ mol/mol AgX |
| Sensitizing dye GS-1 | $4 \times 10^{-4}$ mol/mol AgX |

GS-1

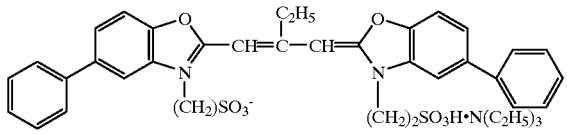

Emulsions 102G to 111G were each prepared, in which sodium thiosulfate or chloroauric acid was dividedly added in a manner similar to Emulsions 102R to 111R.

Preparation of Blue-sensitive Silver Halide Emulsion

Monodisperse cubic grain emulsions, EMP-3 having an average grain size of 0.71 $\mu$m, a variation coefficient of 0.08 and a chloride content of 99.5 mol % and EMP-3B having an average grain size of 0.64 $\mu$m, a variation coefficient of 0.08 and a chloride content of 99.5 mol % each were prepared in the same manner as in preparation of EMP-1, except that an adding time of Solutions A and B, and that of Solution C and D were respectively varied.

The emulsion, EMP-3 was optimally chemical-sensitized at 60° C. using the following compounds. The emulsion, EMP-3B was also optimally chemical-sensitized in a similar manner, and then sensitized EMP-3 and EMP-3B emulsions were blended in a ratio of 1:1 based on the silver amount to obtain a green-sensitive silver halide emulsion (101B).

| | |
|---|---|
| Sodium thiosulfate | $1 \times 10^{-4}$ mol/mol AgX |
| Chloroauric acid | $1.2 \times 10^{-4}$ mol/mol AgX |
| Stabilizer STAB-1 | $2 \times 10^{-4}$ mol/mol AgX |
| Stabilizer STAB-2 | $2.4 \times 10^{-4}$ mol/mol AgX |
| Stabilizer STAB-3 | $2.1 \times 10^{-4}$ mol/mol AgX |
| Sensitizing dye BS-1 | $4 \times 10^{-4}$ mol/mol AgX |
| Sensitizing dye BS-2 | $1 \times 10^{-4}$ mol/mol AgX |

BS-1

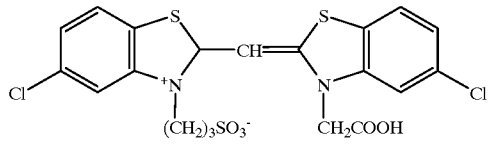

-continued

BS-2

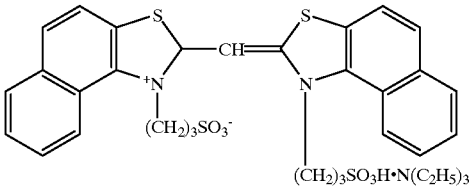

Emulsions 102B to 111B were each prepared, in which sodium thiosulfate or chloroauric acid was dividedly added in a manner similar to Emulsions 102R to 111R.

There was prepared a paper support laminated, on paper with a weight of 180 g/m$^2$, with high density polyethylene, provided that the side to coat an emulsion layer was laminated with polyethylene melt containing surface-treated anatase type titanium oxide in an amount of 15% by weight. The reflection support was subjected to corona discharge and provided with a gelatin sublayer, and further thereon, the following component layers were provided to prepare a silver halide photographic material (101).

1st Layer Coating Solution

To 23.4 g of yellow coupler (Y-1), 3.34 g of dye image stabilizer (ST-1), 3.34 g of dye image stabilizer (ST-2), 3.34 g of dye image stabilizer (ST-5), 0.34 g of antistaining agent (HQ-1), 5.0 g of image stabilizer A, 3.33 g of high boiling organic solvent (DBP) and 1.67 g of high boiling solvent (DNP) was added 60 ml of ethyl acetate. Using a ultrasonic homogenizer, the resulting solution was dispersed in 220 ml of an aqueous 10% gelatin solution containing 7 ml of an aqueous 20% surfactant (SU-1) solution to obtain a yellow coupler dispersion. The obtained dispersion was mixed with the blue-sensitive silver halide emulsion (101B) to prepare a 1st layer coating solution. Coating solutions for the 2nd layer to 7th layer were each prepared similarly to the 1st layer coating soltion, and each coating solution was coated so as to have a coating amount as shown below.

| Layer | Constitution | Amount (g/m$^2$) |
|---|---|---|
| 7th Layer (Protective layer) | Gelatin | 1.00 |
| | DIDP | 0.005 |
| | Silicon dioxide | 0.003 |
| 6th Layer (UV absorbing layer) | Gelatin | 0.40 |
| | UV absorbent (UV-1) | 0.12 |
| | UV absorbent (UV-2) | 0.04 |
| | UV absorbent (UV-3) | 0.16 |
| | Antistaining agent (HQ-5) | 0.04 |
| | PVP | 0.03 |
| | Antiirradiation dye (AI-2) | 0.01 |
| 5th Layer (Red-sensitive layer) | Gelatin | 1.30 |
| | Red-sensitive emulsion (101R) | 0.21 |
| | Cyan coupler (C-1) | 0.25 |

-continued

| Layer | Constitution | Amount (g/m$^2$) |
|---|---|---|
| | Cyan coupler (C-2) | 0.08 |
| | Dye image stabilizer (ST-1) | 0.10 |
| | Antistaining agent (HQ-1) | 0.004 |
| | DOP | 0.34 |
| 4th Layer (UV absorbing layer) | Gelatin | 0.94 |
| | UV absorbent (UV-1) | 0.28 |
| | UV absorbent (UV-2) | 0.09 |
| | UV absorbent (UV-3) | 0.38 |
| | Antistaining agent (HQ-3) | 0.10 |
| | Antiirradiation dye (AI-2) | 0.02 |
| 3rd Layer (Green-sensitive layer) | Gelatin | 1.30 |
| | Green-sensitive Emulsion (101G) | 0.14 |
| | Magenta coupler (M-1) | 0.20 |
| | Dye image stabilizer (ST-3) | 0.20 |
| | Dye image stabilizer (ST-4) | 0.17 |
| | DIDP | 0.13 |
| | DBP | 0.13 |
| | Antiirradiation dye (AI-1) | 0.01 |
| 2nd layer (Interlayer) | Gelatin | 1.20 |
| | Antistaining agent (HQ-2) | 0.03 |
| | Antistaining agent (HQ-3) | 0.03 |
| | Antistaining agent (HQ-4) | 0.05 |
| | Antistaining agent (HQ-5) | 0.23 |
| | DIDP | 0.06 |
| | Brightening agent (W-1) | 0.10 |
| | Antiirradiation dye (AI-3) | 0.01 |
| 1st layer (Blue-sensitive layer) | Gelatin | 1.20 |
| | Blue-sensitive Emulsion (101B) | 0.26 |
| | Yellow coupler (Y-1) | 0.70 |
| | Dye image stabilizer (ST-1) | 0.10 |
| | Dye image stabilizer (ST-2) | 0.10 |
| | Dye image stabilizer (ST-5) | 0.10 |
| | Antistaining agent (HQ-1) | 0.01 |
| | Image stabilizer A | 0.15 |
| | DBP | 0.10 |
| | DNP | 0.05 |
| Support | Polyethylene-laminated paper containing a small amount of colorant | |

Hardeners (H-1) and (H-2) were incorporated. There were also incorporated surfactants, (SU-2) and (SU-3) to adjust surface tension. Antiseptic DI-1 was further incorporated.

SU-1: Sodium tri-i-ptopylnaphthalenesulfonate

SU-2: Di(2-ethylhexyl) sulfosuccinate sodium salt

SU-3: 2,2,3,3,4,4,5,5-Octafluoropentyl sulfosuccinate sodium salt

DBP: Dibutyl phthalate

DNP: Dinonyl phthalate

DOP: Dioctyl phthalate

DIDP: Diisodecyl phthalate

PVP: Polyvinyl pyrrolidone

H-1: Tetrakis(vinylsulfonylmethyl)methane

H-2: 2,4-Dichloro-6-hydroxy-s-triazine sodium salt

Image stabilizer A: p-t-Octylphenol

AI-1
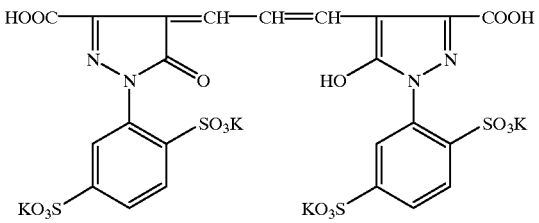
AI-2
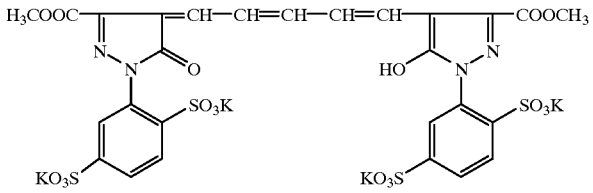
AI-3
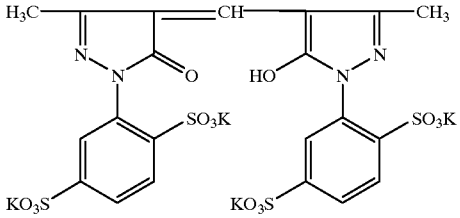
W-1
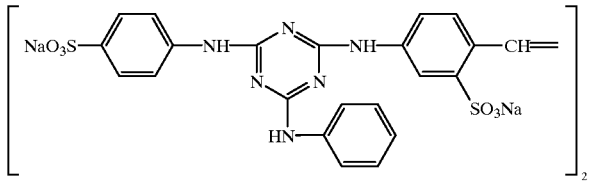
HQ-1
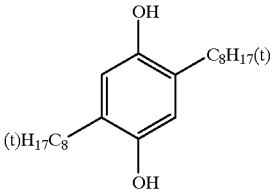
HQ-2
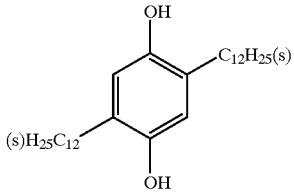
HQ-3
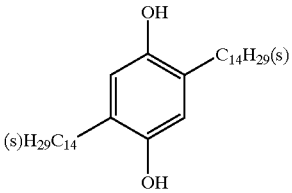
HQ-4
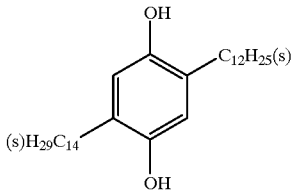
HQ-5
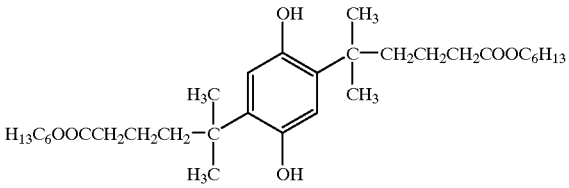
UV-1
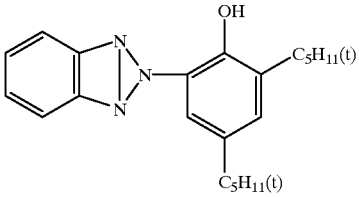
UV-2
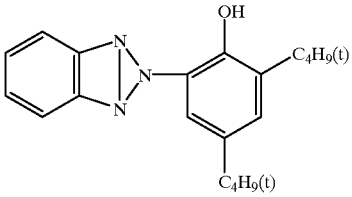

-continued
UV-3
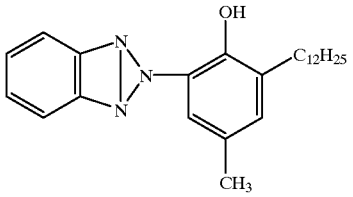
Y-1
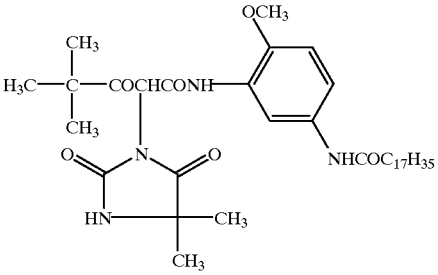
C-1
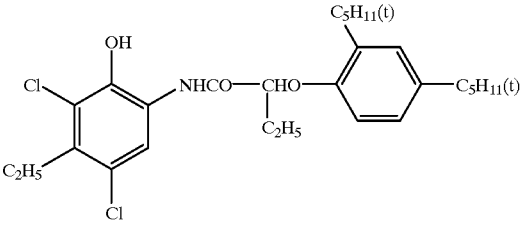
C-2
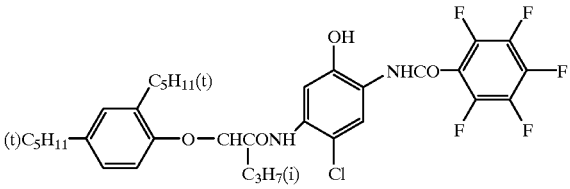
M-1
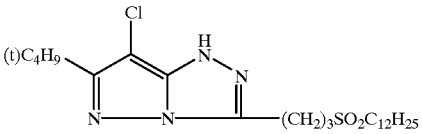
ST-1
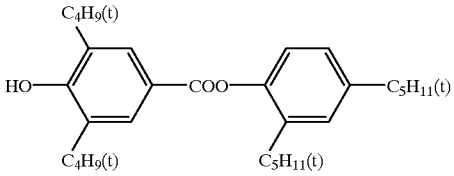
ST-2
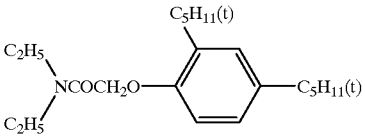
ST-3
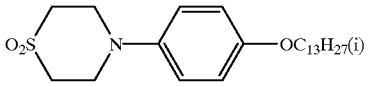

-continued

ST-4

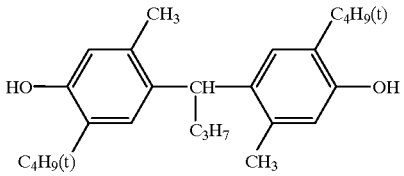

ST-5

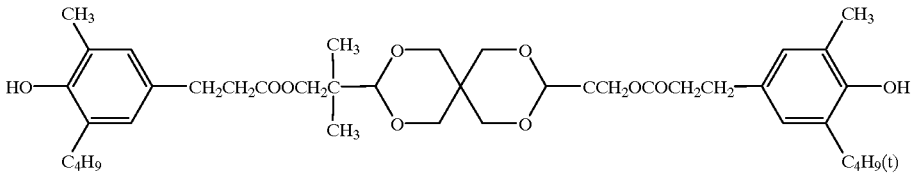

DI-1(Mixture)

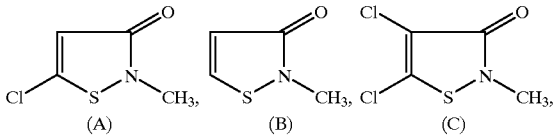

A:B:C: = 50:46:4 (molar ratio)

Photographic material Sample 101 was thus prepared. Furthermore, photographic material Samples 102 to 111 were red in the same manner as Sample 101, except that silver e emulsions used in the 1st, 3rd and 5th layers were d as shown in Table 1.

TABLE 1

| | 1st Layer | 3rd Layer | 5th Layer | Emulsion Making Condition | |
|---|---|---|---|---|---|
| Sample No. | Blue-sensitive Em. | Green-sensitive Em. | Red-sensitive Em. | Sensitizer | Addition*1 Interval (min) |
| 101 | 101B | 101G | 101R | $Na_2S_2C_3$ | Together*2 |
| 102 | 102B | 102G | 102R | $Na_2S_2O_3$ | 10 |
| 103 | 103B | 103G | 103R | $Na_2S_2O_3$ | 60 |
| 104 | 104B | 104G | 104R | $Na_2S_2O_3$ | 100 |
| 105 | 105B | 105G | 105R | $Na_2S_2O_3$ | 200 |
| 106 | 106B | 106G | 106R | $Na_2S_2O_3$ | 200, Continuous*3 |
| 107 | 107B | 107G | 107R | $HAuCl_4$ | 10 |
| 108 | 108B | 108G | 108R | $HAuCl_4$ | 60 |
| 109 | 109B | 109G | 109R | $HAuCl_4$ | 100 |
| 110 | 110B | 110G | 110R | $HAuCl_4$ | 200 |
| 111 | 111B | 111G | 111R | $HAuCl_4$ | 200, Continuous |

*1:Addition interval of a sensitizer
*2:Sensitizer was added altogether at one time.
*3:Sensitizer was continuously added over 200 min.

Photographic material Samples 101 to 111 each were subjected to exposure and processing in the following manner.

Xe Flash-light Exposure

Using Xe flash-light source with an emission time of $10^{-6}$ sec. or less, samples each were exposed, through a combination of an optical stepped wedge and a color filter (any one of Wratten filter No. 29, No. 99 and No. 47B), to any one of red, green and blue lights. Another set of samples were doubly exposed similarly at the interval of 10 sec. At one minute after exposure, exposed samples were processed according to the following process 1. During processing, a color developer solution was optimally replenished so as to maintain optimum conditions.

Process 1

| Step | Temperature | Time |
|---|---|---|
| Color developing | 37.0 ± 0.5° C. | 45 sec. |
| Bleach-fixing | 35.0 ± 2.5° C. | 45 sec. |
| Stabilizing | 35–39° C. | 45 sec. |
| Drying | 60–80° C. | 30 sec. |

Color developer (CD-1)

| | |
|---|---|
| Water | 800 ml |
| Triethylenediamine | 2 g |
| Diethylene glycol | 10 g |
| Potassium bromide | 0.02 g |
| Potassium chloride | 4.5 g |
| Potassium sulfite | 0.25 g |
| N-ethyl-N(β-methanesulfonamidoethyl)-3-methyl-4-aminoaniline sulfate | 4.0 g |
| N,N-diethylhydroxyamine | 5.6 g |
| Triethanolamine | 10.0 g |
| Sodium diethyltriaminepentaacetate | 2.0 g |
| Potassium carbonate | 30 g |

Water is added to make 1 liter, and the pH is adjusted to 10.1 with sulfuric acid or potassium hydroxide.

Bleach-fixer (BF-1)

| | |
|---|---|
| Water | 700 ml |
| Ammonium diethyltriaminepentaacetate dihydrate | 65 g |
| diethyltriaminepentaacetic acid | 3 g |
| Ammonium thiosulfate (70% aqueous solution) | 100 ml |
| 2-Amino-5-mercapto-1,3,4-thiadiazole | 2.0 g |
| Ammonium sulfite (40% aqueous solution) | 27.5 ml |

Water is added to make 1 liter, and the pH is adjusted to 5.0.

| Stabilizer | |
|---|---|
| Water | 800 ml |
| o-Phenylphenol | 1.0 g |
| 5-Chloro-2-methyl-4-isothiazoline-3-one | 0.02 g |
| 2-Methyl-4-isothiazoline-3-one | 0.02 g |
| Diethylene glycol | 1.0 g |
| fluorescent brightener (Chinopal SFP) | 2.0 g |
| 1-Hydroxyethylidene-1,1-diphosphonic acid | 1.8 g |
| Magnesium sulfate heptahydrate | 0.2 g |
| Polyvinyl pyrrolidone | 1.0 g |
| Trisodium nitrilotriacetate | 1.5 g |

Water is added to make 1 liter, and the pH is adjusted to 7.5 with sulfuric acid or potassium hydroxide.

The reflection density of each processed sample was measured using X-Rite 938, a reflection type spectral color densitometer (available from X-Rite Corp.), whereby characteristic curves for each of red-, green- and blue-exposures were obtained. Furthermore, a slope (γ) of a straight line connecting two points corresponding densities of 0.5 and 1.5 on the characteristic curve determined for each of yellow, magenta and cyan images, and variation of the average gradation were determined, based formula (A) afore-mentioned.

Image Output Through Scanning Exposure

Using, as a light source, a semiconductor laser (oscillation wavelength of 650 nm), a He—Ne gas laser (oscillation wavelength of 544 nm) or an Ar gas laser (oscillation wavelength of 458 nm), each processed sample was subjected to main-scanning through a polygon mirror with modulating the light amount of each laser beam by means of AOM, based on image data and was concurrently shifted perpendicularly to the main-scanning direction to perform sub-scanning exposure, wherein the beam diameter for each of BGR was confirmed to be 100 μm utilizing a beam monitor. The mean exposure time per pixel was $5\times10^{-7}$ sec. Using this apparatus, the following two types of exposure were conducted:

(1) Uniform scanning exposure, in which the main-scanning and sub-scanning speeds were so adjusted that overlap between rasters was 18%, under the conditions of obtaining a gray patch with status A reflection density (R,G,B) of (2.2,2.1,2.0) and (2) Exposure of "A" to "Z" letters with varying their sizes from Hervetica 4 points to 18 points, in which the main-scanning and sub-scanning speeds were so adjusted that overlap between rasters was 18%, under the conditions of obtaining gray patch with status A reflection density (R,G,B) of (2.2,2.1,2.0).

One minute after exposure, exposed samples were processed according to the process 1 afore-mentioned. Evaluation of uneven density in an overall gray image Samples 101 to 111, which were subjected to exposure (1) described above and then processed, were subjected to densitometry over a range of 5 mm, using microdensitometer PDM-5AR (available from Konica Corp.) in combination with a green filter (Kodak Wratten Filter No. 99) at a magnification of 50 times, an aperture size of 400×4 μm and at an interval of 4 μM, and were scanned in the main-scanning direction and also in the direction perpendicular to it. Uneven density was evaluated, based on the maximum difference in density. The lower value indicates that the density of an overall even gray image density was reliably reproduced.

Evaluation of Fine Line Clearness

Samples 101 to 111, which were subjected to exposure (2) described above and subsequently processed, were visually evaluated by 20 people with respect to image density evenness. The less unevenness, the higher points (at a maximum of 100 points) was assigned. Thus, the higher the average point of 20 people, the clearer reproduction of fine text. Evaluation was made based on the following criteria:

100-81: fine text can be clearly read substantially without color doubling;

80-61: fine text can be read but with slight doubling of the contours;

60-41: fine text is slightly unclear with slight doubling of the contours; and 40 or less: fine text is unclear on the contours.

These results are shown in Table 2, along with variations of the average gradation at multiple exposure.

TABLE 2

| Sample | Variation of Average gradation (%) | | | Density | Text | |
|---|---|---|---|---|---|---|
| No. | ΔγB | ΔγG | ΔγR | Evenness | Reproduction | Remark |
| 101 | 43 | 41 | 66 | 0.27 | 35 | Comp. |
| 102 | 17 | 8 | 11 | 0.21 | 40 | Comp. |
| 103 | 9 | 8 | 7 | 0.13 | 75 | Inv. |
| 104 | 3 | 4 | 7 | 0.14 | 85 | Inv. |
| 105 | 2 | 5 | 6 | 0.15 | 90 | Inv. |
| 106 | 8 | 4 | 7 | 0.11 | 90 | Inv. |
| 107 | 13 | 11 | 15 | 0.24 | 45 | Comp. |
| 108 | 6 | 10 | 9 | 0.16 | 75 | Inv. |
| 109 | 8 | 6 | 5 | 0.14 | 80 | Inv. |
| 110 | 3 | 4 | 5 | 0.09 | 100 | Inv. |
| 111 | 10 | 9 | 8 | 0.13 | 85 | Inv. |

As can be seen from Table 2, Sample 101 and 107 were not preferred, exhibiting more than 10% of the gradation variation in all of the color image forming layers, producing uneven gray image density and unclear contours in fine text images. Sample 102 was also not preferred, exhibiting a large variation of gradation in the yellow image forming layer, specifically producing yellow bleeding-out on the contours of fine text images and leading to an inferior result. Samples 103 and 108 to 111 were preferred, each exhibiting less than 10% of the gradation variation in all of the color image forming layers, reproducing even gray-image density and superior reproduction of fine text images.

Example 2

Photographic material Samples 201 to 208 were prepared in a manner similar to Sample 101 of Example 1, provided that silver halide emulsions used in the 1st, 3rd and 5th layers were varied as shown in Table 6. Silver halide emulsions used in Samples 201 to 208 were prepared in a manner similar to Emulsions (101R), (101G) and (101B), provided that the contents of $K_2IrCl_6$ and $K_4Fe(CN)_6$ of Solution C, and the amounts of stabilizers (STAB-1), (STAB-2) and (STAB-3) used in chemical sensitization were respectively varied, as shown in Table 3.

TABLE 3

| Emulsion | $K_2IrCl_6$ (mol) | $K_4Fe(CN)_6$ (mol) | (STAB-1) (mol/mol AgX) | (STAB-2) (mol/mol AgX) | (STAB-3) (mol/mol AgX) |
|---|---|---|---|---|---|
| 201B | $4 \times 10^{-8}$ | $2 \times 10^{-5}$ | $3 \times 10^{-4}$ | $3 \times 10^{-4}$ | $3 \times 10^{-4}$ |
| 202B | $1 \times 10^{-7}$ | $3 \times 10^{-5}$ | $3 \times 10^{-4}$ | $3 \times 10^{-4}$ | $3 \times 10^{-4}$ |
| 203B | $4 \times 10^{-8}$ | $2 \times 10^{-5}$ | $6 \times 10^{-5}$ | $3 \times 10^{-4}$ | $6 \times 10^{-5}$ |
| 204B | $1 \times 10^{-7}$ | $3 \times 10^{-5}$ | $6 \times 10^{-5}$ | $3 \times 10^{-4}$ | $6 \times 10^{-5}$ |
| 201G | $4 \times 10^{-8}$ | $2 \times 10^{-5}$ | $3 \times 10^{-4}$ | $3 \times 10^{-4}$ | $3 \times 10^{-4}$ |
| 202G | $1 \times 10^{-7}$ | $3 \times 10^{-5}$ | $3 \times 10^{-4}$ | $3 \times 10^{-4}$ | $3 \times 10^{-4}$ |
| 203G | $4 \times 10^{-8}$ | $2 \times 10^{-5}$ | $6 \times 10^{-5}$ | $3 \times 10^{-4}$ | $6 \times 10^{-5}$ |
| 204G | $1 \times 10^{-7}$ | $3 \times 10^{-5}$ | $6 \times 10^{-5}$ | $3 \times 10^{-4}$ | $6 \times 10^{-5}$ |
| 201R | $4 \times 10^{-8}$ | $2 \times 10^{-5}$ | $3 \times 10^{-4}$ | $3 \times 10^{-4}$ | $3 \times 10^{-4}$ |
| 202R | $1 \times 10^{-7}$ | $3 \times 10^{-5}$ | $3 \times 10^{-4}$ | $3 \times 10^{-4}$ | $3 \times 10^{-4}$ |
| 203R | $4 \times 10^{-8}$ | $2 \times 10^{-5}$ | $6 \times 10^{-5}$ | $3 \times 10^{-4}$ | $6 \times 10^{-5}$ |
| 204R | $1 \times 10^{-7}$ | $3 \times 10^{-5}$ | $6 \times 10^{-5}$ | $3 \times 10^{-4}$ | $6 \times 10^{-5}$ |

Samples 201 to 208 were each subjected to exposure and evaluated in the same manner as in Example 1. Furthermore, variations of the gradation were determined according to afore-mentioned formulas (1) and (2). Results thereof are shown in Table 4.

TABLE 4

| Sample No. | Emulsion 1st Layer | 2nd layer | 3rd Layer | Average gradation % ΔγB | ΔγG | ΔγR | Value of Formula (1) | Value of Formula (2) | Density Evenness | Text Reproduction | Remark |
|---|---|---|---|---|---|---|---|---|---|---|---|
| 201 | 201B | 201G | 201R | 56 | 24 | 9 | 0.36 | 0.25 | 0.29 | 15 | Comp. |
| 202 | 202B | 202G | 202R | 29 | 19 | 17 | 0.09 | 0.02 | 0.29 | 70 | Comp. |
| 203 | 203B | 203G | 203R | 9 | 6 | 3 | 0.02 | 0.02 | 0.13 | 90 | Inv. |
| 204 | 204B | 204G | 204R | 5 | 5 | 7 | 0.00 | 0.02 | 0.14 | 100 | Inv. |
| 205 | 203B | 204G | 203R | 9 | 5 | 3 | 0.02 | 0.01 | 0.12 | 95 | Inv. |
| 206 | 204B | 203G | 204R | 5 | 6 | 7 | 0.01 | 0.01 | 0.12 | 100 | Inv. |
| 207 | 203B | 201G | 203R | 9 | 24 | 3 | 0.27 | 0.45 | 0.23 | 30 | Comp. |
| 208 | 204B | 201G | 204R | 5 | 24 | 7 | 0.42 | 0.49 | 0.24 | 10 | Comp. |

As can be seen from Table 4, Sample 201 exhibited more than 10% of the gradation variation in the yellow and magenta image forming layers, producing markedly uneven gray image density, and did not meet the preferred requirements of formulas (1) and (2). Furthermore, color tone of super-fine line images, which was to be a neutral hue on the image data appeared to be shifted to magenta or red, and the super-fine lines appeared to be wider due to bleeding on the fringes. Sample 202 was not preferred, exhibiting more than 10% of the gradation variation in all of the color image forming layers and producing markedly uneven gray image density. Samples 207 and 208 exhibited more than 10% of the gradation variation in the magenta image forming layers, producing a markedly uneven gray image density, and did not meet the preferred requirements of formulas (1) and (2). Further, the color tone of super-fine line images, which was to be a neutral hue on the image data base, appeared to be shifted to cyan or green, and the super-fine lines appeared to be wider due to bleeding on the fringes.

Samples 203 to 206 each satisfied the preferred requirements of formulas (1) and (2), reproducing super-fine line images without failure in color tone and bleeding on the fringes and being at overall acceptable levels. As can be seen from these results, when requirements of formulas (1) and (2) are satisfied, color reproduction failure of super-fine line images and black texts with bleeding fringe are preferably reduced in scanning exposure.

Example 3

Photographic material Samples 301 to 308 were prepared in a manner similar to Sample 101 of Example 1, provided that silver halide emulsions used in the 1st, 3rd and 5th layers were varied as shown in Table 6. Silver halide emulsions used in Sample 301 to 308 were prepared in a manner similar to Emulsions (101R), (101G) and (101B), provided that the contents of $K_2IrCl_6$ and $K_4Fe(CN)_6$ of Solution C, and the amounts of stabilizers (STAB-1), (STAB-2) and (STAB-3) used in chemical sensitization were respectively varied, as shown in Table 5.

TABLE 5

| Emulsion | $K_2IrCl_6$ (mol) | $K_4Fe(CN)_6$ (mol) | (STAB-1) (mol/mol AgX) | (STAB-2) (mol/mol AgX) | (STAB-3) (mol/mol AgX) |
|---|---|---|---|---|---|
| Em-B1 | $4 \times 10^{-8}$ | $2 \times 10^{-5}$ | $3 \times 10^{-4}$ | $3 \times 10^{-4}$ | $3 \times 10^{-4}$ |
| Em-B5 | $2 \times 10^{-7}$ | $2 \times 10^{-5}$ | $3 \times 10^{-4}$ | $3 \times 10^{-4}$ | $3 \times 10^{-4}$ |
| Em-B6 | $4 \times 10^{-8}$ | $2 \times 10^{-5}$ | $8 \times 10^{-5}$ | $6 \times 10^{-5}$ | $3 \times 10^{-4}$ |

TABLE 5-continued

| Emulsion | $K_2IrCl_6$ (mol) | $K_4Fe(CN)_6$ (mol) | (STAB-1) (mol/mol AgX) | (STAB-2) (mol/mol AgX) | (STAB-3) (mol/mol AgX) |
|---|---|---|---|---|---|
| Em-B7 | $2 \times 10^{-7}$ | $2 \times 10^{-5}$ | $8 \times 10^{-5}$ | $6 \times 10^{-5}$ | $3 \times 10^{-4}$ |
| Em-G1 | $4 \times 10^{-8}$ | $2 \times 10^{-5}$ | $3 \times 10^{-4}$ | $3 \times 10^{-4}$ | $3 \times 10^{-4}$ |
| Em-G5 | $2 \times 10^{-7}$ | $2 \times 10^{-5}$ | $3 \times 10^{-4}$ | $3 \times 10^{-4}$ | $3 \times 10^{-4}$ |
| Em-G6 | $4 \times 10^{-8}$ | $2 \times 10^{-5}$ | $8 \times 10^{-5}$ | $6 \times 10^{-5}$ | $3 \times 10^{-4}$ |
| Em-G7 | $2 \times 10^{-7}$ | $2 \times 10^{-5}$ | $8 \times 10^{-5}$ | $6 \times 10^{-5}$ | $3 \times 10^{-4}$ |
| Em-R1 | $4 \times 10^{-8}$ | $2 \times 10^{-5}$ | $3 \times 10^{-4}$ | $3 \times 10^{-4}$ | $3 \times 10^{-4}$ |
| Em-R5 | $2 \times 10^{-7}$ | $2 \times 10^{-5}$ | $3 \times 10^{-4}$ | $3 \times 10^{-4}$ | $3 \times 10^{-4}$ |
| Em-R6 | $4 \times 10^{-8}$ | $2 \times 10^{-5}$ | $8 \times 10^{-5}$ | $6 \times 10^{-5}$ | $3 \times 10^{-4}$ |
| Em-R7 | $2 \times 10^{-7}$ | $2 \times 10^{-5}$ | $8 \times 10^{-5}$ | $6 \times 10^{-5}$ | $3 \times 10^{-4}$ |

Samples 301 to 308 were each subjected to exposure and evaluated in the same manner as in Example 1. Furthermore, using the same exposure apparatus, scanning exposure was conducted based on the image data prepared in Adobe Photoshop 3.0-J. Images employed had resolution of 300 dpi, containing image unit comprised of a combination of an achromatic square image of 100×100 pixels; achromatic, yellow, magenta and cyan fine line images of 500×1 pixels, 500×2 pixels and 500×5 pixels, respectively; yellow, magenta and cyan square images of 1000×100 pixels; and yellow, magenta and cyan small dot images of 2×2 pixels. In each image of the image unit, yellow, magenta and cyan image portions were prepared so that the RGB data value in the Photoshop was either (255, 255, 0), (255, 0, 255) or (0, 255, 255). Achromatic square images and fine line image portions were prepared via 18 steps so that the RGB data value in the Photoshop was varied from (255, 255, 255) to (0, 0, 0) at an interval of 5. After adjusting LUT to control exposure so that the achromatic square image portion of 100×100 pixels, which was exposed so that the overlap between light beam rasters was 25%, reproduced a neutral gray (achromatic color), print samples for evaluation were prepared using each photographic material sample. Exposed samples were processed within 1 min. after exposure.

In each print sample, reflection densities of yellow, magenta and cyan square image portions of 1000×1000 pixels, and yellow, magenta and cyan small dot image portions of 2×2 pixels were measured using a microdensitometer (PDM-5AR, available from Konica Corp.) at an overall magnification of 50 times, with 400×4 $\mu$m of aperture and at 4 $\mu$m intervals. In the densitometry of each sample, Wratten filters (any one of R, G and B) corresponding to complimentary colors of the color image portions were used, and the zero point was adjusted so that the density of unexposed portions (being a white background) of each print sample was 0.00. Using the obtained densities, values corresponding formulas (3) and (4) were determined, as shown in Table 6. The thus obtained print samples were visually evaluated by twenty persons with respect to difference in color tone between the achromatic square portion and the achromatic fine line image portion, and doubling in edge portions of the fine line image. Results thereof are shown in Table 6.

TABLE 6

| Sample No. | Emulsion 1st Layer | 2nd layer | 3rd Layer | Average gradation % ΔγB | ΔγG | ΔγR | Value of Formula (1) | Value of Formula (2) | Density Evenness | Text Reproduction | Remark |
|---|---|---|---|---|---|---|---|---|---|---|---|
| 301 | 201B | 201G | 201R | 56 | 24 | 9 | 0.84 | 0.41 | 0.33 | 15 | Comp. |
| 302 | 205B | 205G | 205R | 29 | 21 | 18 | 0.33 | 0.25 | 0.30 | 65 | Comp. |
| 303 | 206B | 206G | 206R | 9 | 5 | 4 | 0.22 | 0.18 | 0.12 | 90 | Inv. |
| 304 | 207B | 207G | 207R | 6 | 6 | 6 | 0.15 | 0.14 | 0.09 | 100 | Inv. |
| 305 | 206B | 207G | 206R | 9 | 6 | 4 | 0.23 | 0.19 | 0.10 | 95 | Inv. |
| 306 | 207B | 206G | 207R | 6 | 5 | 6 | 0.24 | 0.23 | 0.11 | 100 | Inv. |
| 307 | 206B | 201G | 206R | 9 | 27 | 4 | 0.58 | 0.51 | 0.23 | 30 | Comp. |
| 308 | 207B | 201G | 207R | 6 | 27 | 6 | 0.92 | 0.53 | 0.24 | 10 | Comp. |

As can be seen from Table 6, Samples 301 and 302, which id not fall within the scope of the present invention, exhibited more than 10% of the gradation variation in the yellow and magenta image forming layers, producing a markedly uneven gray image density. Furthermore, color tone of super-fine line images, which was to be a neutral hue on the image data base, appeared to be shifted toward yellow, and the super-fine lines appeared to be wider due to bleeding fringes, so that few judged them to be acceptable. Samples 307 and 308, which also did not fall within the scope of the invention, produced a markedly uneven gray image density. Furthermore, color tone of super-fine line images, which was to be a neutral hue on the image data base, appeared to be shifted toward the side of magenta to red, and the super-fine lines appeared to be wider due to bleeding fringe. Samples 303 to 306 each satisfied the preferred requirements of formulas (3) and (4), reproducing super-fine line images without failure in color tone and bleeding fringe, so that most judged them to be at acceptable levels. As can be seen from these results, when requirements of formulas (3) and (4) are satisfied, color reproduction failure of super-fine line images and black texts with bleeding fringes are favorably reduced in scanning exposure.

Example 4

Photographic material Samples 401 to 406 were prepared in a manner similar to Sample 208 of Example 2, provided that a silver halide emulsions used in the 3rd layer was varied as shown in Table 7. Thus, silver halide emulsions used in the 3rd layer 401G to 406G each were prepared in the following manner.

Preparation of Silver Halide Emulsion 401G

Silver halide emulsion 401G was prepared in a manner similar to silver halide emulsion 201G, provided that fine silver chloride grains were instantaneously added before starting chemical sensitization. The fine silver chloride grains, which had an average grain size of 0.15 $\mu$m and contain $1\times10^{31\ 5}$ mol/mol Ag of potassium hexachloroiridate (IV), were previously prepared using another silver halide grain forming apparatus.

Preparation of Silver Halide Emulsion 402G

Silver halide emulsion 402G was prepared in a manner similar to silver halide emulsion 201G, provided that fine silver bromide grains were instantaneously added before starting chemical sensitization. The fine silver bromide grains, which had an average grain size of 0.05 $\mu$m and contain $1\times10^{-5}$ mol/mol Ag of potassium hexachloroiridate (IV), were previously prepared according to the method described in U.S. Pat. No. 5,627,020, using another silver halide grain forming apparatus.

Preparation of Silver Halide Emulsion 403G

Silver halide emulsion 403G was prepared in a manner similar to silver halide emulsion 201G, provided that fine silver bromide grains were continuously added over a period of 10 min. before starting chemical sensitization. The fine silver bromide grains, which had an average grain size of 0.02 $\mu$m and did not contain potassium hexachloroiridate (IV), were prepared using an apparatus, as shown in FIG. 1 and added immediately after forming grains.

Preparation of Silver Halide Emulsion 404G

Silver halide emulsion 404G was prepared in a manner similar to silver halide emulsion 201G, provided that fine silver chloride grains were continuously added over a period of 10 min. before starting chemical sensitization. The fine silver chloride grains, which had an average grain size of 0.09 $\mu$m and contain $1\times10^{-5}$ mol/mol Ag of potassium hexachloroiridate (IV), were prepared using an apparatus, as shown in FIG. 1 and added immediately after forming grains.

Preparation of Silver Halide Emulsion 405G

Silver halide emulsion 405G was prepared in a manner similar to silver halide emulsion 403G, provided that the fine silver bromide grains contained $1\times10^{-5}$ mol/mol Ag of potassium hexachloroiridate (IV).

Preparation Silver Halide Emulsion 406G

Silver halide emulsion 406G was prepared in a manner similar to silver halide emulsion 405G, provided that the fine silver bromide grains were prepared using an apparatus having a ultrafiltration module, as shown in FIG. 2.

In preparation of silver halide emulsions 401G to 406G, the amount of the fine silver halide grains added before chemical sensitization was 1%, based on an equivalent silver amount of silver halide grains to be chemically sensitized (i.e., host silver halide grains).

Prepared Samples 401 to 406 were subjected to exposure and processing, and evaluated in the same manner as in Example 1. Furthermore, Samples 401 to 406 were subjected to exposure and processing in the same manner as in Example 3. In each print sample, the reflection density of magenta fine line image of 500×1 pixels was measured using a microdensitometer (PDM-5AR, available from Konica Corp.) at overall magnification of 50 times, with 500×5 $\mu$m aperture and at 1 $\mu$m intervals. In densitometry of each sample, Wratten green filters was used, and the zero point was adjusted so that the density of unexposed portions (white background) of each print sample was 0.00. Based on the fine line profile obtained from the densitometry results, the half-width and toe-width afore-defined were determined and the ratio of toe-width to half-width was calculated, as shown in Table 7.

TABLE 7

| Sample No. | Emulsion (3rd layer) | Variation of Average gradation (%) ΔγB | ΔγG | ΔγR | Toe-width/Half-width | Evenness | Reproduction | Remark |
|---|---|---|---|---|---|---|---|---|
| 401 | 401G | 5 | 9 | 7 | 3.4 | 0.13 | 80 | Inv. |
| 402 | 402G | 5 | 8 | 7 | 3.6 | 0.12 | 80 | Inv. |
| 403 | 403G | 5 | 6 | 7 | 2.5 | 0.10 | 90 | Inv. |
| 404 | 404G | 5 | 5 | 7 | 1.8 | 0.09 | 90 | Inv. |
| 405 | 405G | 5 | 3 | 7 | 1.6 | 0.10 | 95 | Inv. |
| 406 | 406G | 5 | 4 | 7 | 1.5 | 0.09 | 100 | Inv. |

As can be seen from Table 7, Samples 403 to 406, which exhibited 1.2 to 3.0 of the ratio of toe-width to half-width in magenta images obtained through exposure of a line of one pixel in width, were superior in reproduction of text images, as compared to Samples 401 and 402.

Example 5

Preparation of Red-sensitive Emulsion 501R to 506R

Silver halide emulsion 501R was prepared in a manner similar to silver halide emulsion 101R of Example 1, provided that the molar ratio of sodium thiosulfate to chloroauric acid was 1.3 and the amounts of stabilizers STAB-1 to STAB-3 were optimized so as to achieve desired sensitivity. Silver halide emulsions 502R to 506R were prepared in a manner similar to silver halide emulsion 501R, provided that the molar ratio of sodium thiosulfate to chloroauric acid was 1.0, 0.8, 0.6, 0.4 and 0.3, respectively, and the amounts of stabilizers STAB-1 to STAB-3 were optimized so as to achieve desired sensitivity.

Preparation of Green-sensitive Emulsion 501G to 506G

Silver halide emulsions 501G to 506G were prepared in a manner similar to silver halide emulsion 101G of Example 1, provided that similarly to preparation of the above-described emulsions 501R to 506R, the molar ratio of sodium thiosulfate to chloroauric acid was varied by varying the amount of sodium thiosulfate.

Preparation of Blue-sensitive Emulsion 501B to 506B

Silver halide emulsions 501B to 506B were prepared in a manner similar to silver halide emulsion 101B of Example 1, provided that similarly to preparation of the above-described emulsions 501R to 506R, the molar ratio of sodium thiosulfate to chloroauric acid was varied by varying the amount of sodium thiosulfate.

Preparation of Photographic Materials 501 to 506

Photographic material Samples 501 to 506 were prepared in a manner similar to Sample 1 of Example 1, provided that silver halide emulsions used in the 1st, 3rd and 5th layers were varied as shown in Table 8. Samples 501 to 506 each were subjected to exposure and processing, and evaluated in the same manner as in Example 1. Results thereof are shown in Table 8.

Photographic material Samples 601 to 612 were prepared in a manner similar to Sample 101 of Example 1, provided that silver halide emulsions used in the 1st, 3rd and 5th layers were varied as shown in Table 9. Dyes used in emulsions 101R, 101G and 101B were added to each coating solution, together with a silver halide emulsion, before coating. Thus prepared photographic material Samples 601 to 612 were subjected to exposure and processing, and evaluated in the same manner as in Example 1. Results thereof are shown in Table 9.

TABLE 8

| Sample No. | Emulsion 1st Layer | Emulsion 2nd layer | Emulsion 3rd Layer | $Na_2S_2O_3/HAuCl_4$ (molar ratio) | Variation of Average gradation % ΔγB | ΔγG | ΔγR | Density Evenness | Text Reproduction | Remark |
|---|---|---|---|---|---|---|---|---|---|---|
| 501 | 501B | 501G | 501R | 1.3/1 | 58 | 65 | 51 | 0.33 | 15 | Comp. |
| 502 | 502B | 502G | 502R | 1.0/1 | 30 | 59 | 47 | 0.24 | 30 | Comp. |
| 503 | 503B | 503G | 503R | 0.8/1 | 22 | 21 | 33 | 0.24 | 50 | Comp. |
| 504 | 504B | 504G | 504R | 0.6/1 | 21 | 13 | 13 | 0.27 | 45 | Comp. |
| 505 | 505B | 505G | 505R | 0.4/1 | 10 | 10 | 10 | 0.09 | 95 | Inv. |
| 506 | 506B | 506G | 506R | 0.3/1 | 6 | 8 | 9 | 0.11 | 100 | Inv. |

As can be seen from Table 8, Samples 505 and 506, in which the molar ratio of sodium thiosulfate to chloroauric acid was not more than 0.5, satisfied requirements of the invention, reproducing an even gray image density and superior reproduction of fine texts.

Example 6

Preparation of Red-sensitive Emulsions 601R to 612R

Silver halide emulsion 601R was prepared in a manner similar to silver halide emulsion 101R of Example 1, provided that 15 mg/mol AgX of dye R-1 was added at 100 min. after starting chemical sensitization. Silver halide emulsion 602R was prepared in a manner similar to emulsion 601R, provided that the dye, R-1 was added when completing chemical ripening. Silver halide emulsions 603R and 604R were prepared in a manner similar to emulsions 601R and 602R, respectively, provided that the amount of the dye R-1 was varied to 8 mg/mol AgX. Silver halide emulsions 605R and 606R were prepared in a manner similar to emulsions 601R and 602R, respectively, provided that the amount of the dye R-1 was varied to 2 mg/mol AgX. Silver halide emulsions 607R to 612R were prepared in a manner similar to emulsions 601r to 606R, respectively, provided that the dye, R-1 was changed to dye R-2.

Preparation of Green-sensitive Emulsion 601G to 612G

Silver halide emulsions 601G to 612G were prepared in a manner similar to silver halide emulsion 101G of Example 1, provided that similarly to using dyes R-1 and R-2 in emulsions 601R to 612R, dyes G-1 and G-2 were used.

Preparation of Green-sensitive Emulsion 601B to 612B

Silver halide emulsions 601B to 612B were prepared in a manner similar to silver halide emulsion 101B of Example 1, provided that similarly to using dyes R-1 and R-2 in emulsions 601R to 612R, dyes B-1 and B-2 were used.

Preparation of Photographic Materials 601 to 612

Dye R-1

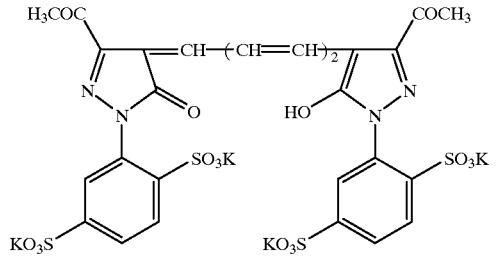

Dye G-1

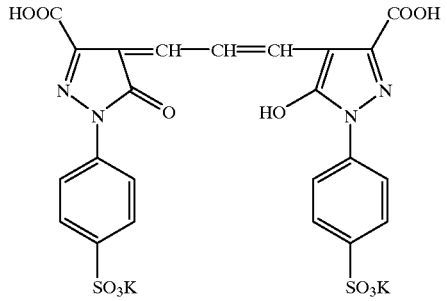

Dye B-1

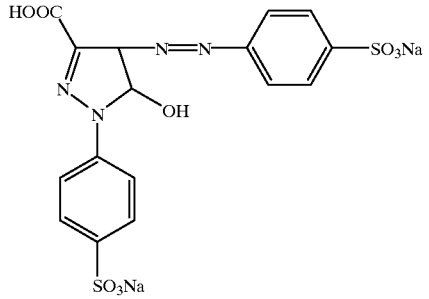

-continued

Dye R-2

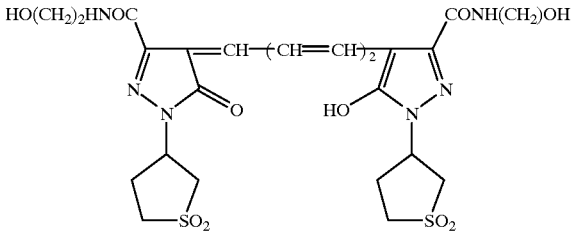

Dye G-2

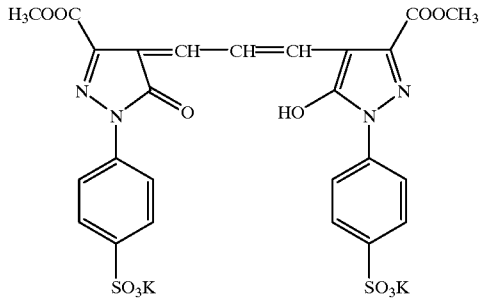

Dye B-2

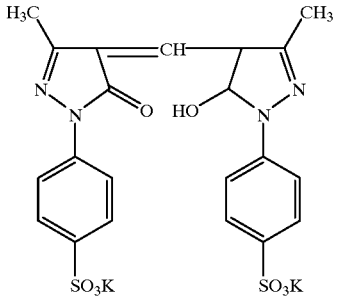

As can be seen from Table 9, Samples, in which the total amount of added dye was not more than 10 mg/mol AgX, satisfied requirements of the invention, reproducing even gray image density and superior reproduction of fine texts.

Example 7

Photographic material Samples 701 to 709 were prepared in a manner similar to Samples 601 to 609 of Example 6, provided that desensitizing dye D-1 was used in place of dye B-1, G-1 or R-1. Samples 710 to 718 were prepared in a manner similar to Samples 610 to 618 of Example 6, provided that desensitizing dye D-2 was used in place of dye B-2, G-2 or R-2. Thus prepared photographic material Samples 701 to 712 were subjected to exposure and processing, and evaluated in the same manner as in Example 1. Results thereof are shown in Table 10.

D-1

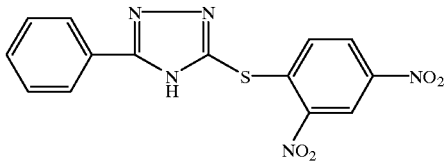

TABLE 9

| Sample No. | Emulsion 1st Layer (Dye) | 2nd layer (DYE) | 3rd Layer (Dye) | Total Dye Amount (mg/mol AgX) | Add. time of Dye | Variation of Average gradation (%) ΔγB | ΔγG | ΔγR | Density Evenness | Text Reproduction | Remark |
|---|---|---|---|---|---|---|---|---|---|---|---|
| 601 | 101B(B-1) | 101G(G-1) | 101R(R-1) | 15 | A | 20 | 41 | 31 | 0.30 | 75 | Comp. |
| 602 | 601B(B-1) | 601G(G-1) | 601R(R-1) | 15 | B | 31 | 40 | 24 | 0.30 | 70 | Comp. |
| 603 | 602B(B-1) | 602G(G-1) | 602R(R-1) | 15 | C | 52 | 38 | 24 | 0.29 | 70 | Comp. |
| 604 | 101B(B-1) | 101G(G-1) | 101R(R-1) | 8 | A | 39 | 44 | 40 | 0.25 | 60 | Comp. |
| 605 | 603B(B-1) | 603G(G-1) | 603R(R-1) | 8 | B | 4 | 9 | 7 | 0.14 | 75 | Inv. |
| 606 | 604B(B-1) | 604G(G-1) | 604R(R-1) | 8 | C | 8 | 7 | 4 | 0.12 | 80 | Inv. |
| 607 | 101B(B-1) | 101G(G-1) | 101R(R-1) | 2 | A | 11 | 27 | 22 | 0.17 | 55 | Comp. |
| 608 | 605B(B-1) | 605G(G-1) | 605R(R-1) | 2 | B | 5 | 9 | 6 | 0.12 | 80 | Inv. |
| 609 | 606B(B-1) | 606G(G-1) | 606R(R-1) | 2 | C | 8 | 8 | 9 | 0.11 | 95 | Inv. |
| 610 | 101B(B-2) | 101G(G-2) | 101R(R-2) | 15 | A | 40 | 47 | 55 | 0.25 | 30 | Comp. |
| 611 | 607B(B-2) | 607G(G-2) | 607R(R-2) | 15 | B | 13 | 3 | 12 | 0.24 | 45 | Comp. |
| 612 | 608B(B-2) | 608G(G-2) | 608R(R-2) | 15 | C | 21 | 30 | 21 | 0.22 | 40 | Comp. |
| 613 | 101B(B-2) | 101G(G-2) | 101R(R-2) | 8 | A | 38 | 34 | 39 | 0.24 | 40 | Comp. |
| 614 | 609B(B-2) | 609G(G-2) | 609R(R-2) | 8 | B | 8 | 4 | 6 | 0.12 | 85 | Inv. |
| 615 | 610B(B-2) | 610G(G-2) | 610R(R-2) | 8 | C | 8 | 7 | 8 | 0.11 | 80 | Inv. |
| 616 | 101B(B-2) | 101G(G-2) | 101R(R-2) | 2 | A | 19 | 35 | 28 | 0.25 | 70 | Comp. |
| 617 | 611B(B-2) | 611G(G-2) | 611R(R-2) | 2 | B | 8 | 8 | 7 | 0.13 | 90 | Inv. |
| 618 | 612B(B-2) | 612G(G-2) | 612R(R-2) | 2 | C | 9 | 9 | 5 | 0.12 | 95 | Inv. |

A: Added to a coating solution
B: Added at 100 min. after starting chemical ripening
C: Added when completing chemical ripening -continued

D-2

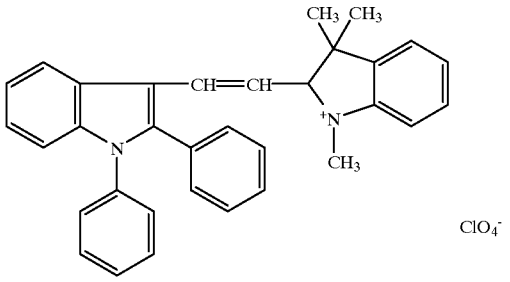

Example 8

Photographic material Samples 801 to 804 were prepared in a manner similar to Samples of 201 to 204 of Example 2, provided that the adding amounts of dyes (AI-1), (AI-2) and (AI-3) were varied so that the ratio of reflected light to incident light, i.e., reflectance (%) at the wavelength of 670 nm was a value as shown in Table 11. Thus prepared photographic material Samples 801 to 804 were subjected to exposure and processing, and evaluated in the same manner as in Example 1. Further, Samples 201 and 204 of Example 2 were also employed as a reference sample. Results thereof are shown in Table 11.

TABLE 10

| Sample No. | Emulsion 1st Layer (Dye) | 2nd layer (DYE) | 3rd Layer (Dye) | Total Dye Amount (mg/mol AgX) | Add. time of Dye | Variation of Average gradation (%) ΔγB | ΔγG | ΔγR | Density Evenness | Text Reproduction | Remark |
|---|---|---|---|---|---|---|---|---|---|---|---|
| 701 | 101B(D-1) | 101G(D-1) | 101R(D-1) | 15 | A | 21 | 45 | 41 | 0.19 | 45 | Comp. |
| 702 | 701B(D-1) | 701G(D-1) | 701R(D-1) | 15 | B | 20 | 30 | 18 | 0.27 | 55 | Comp. |
| 703 | 702B(D-1) | 702G(D-1) | 702R(D-1) | 15 | C | 18 | 22 | 21 | 0.29 | 55 | Comp. |
| 704 | 101B(D-1) | 101G(D-1) | 101R(D-1) | 8 | A | 35 | 31 | 51 | 0.26 | 50 | Comp. |
| 705 | 703B(D-1) | 703G(D-1) | 703R(D-1) | 8 | B | 7 | 8 | 8 | 0.15 | 80 | Inv. |
| 706 | 704B(D-1) | 704G(D-1) | 704R(D-1) | 8 | C | 8 | 9 | 7 | 0.13 | 95 | Inv. |
| 707 | 101B(D-1) | 101G(D-1) | 101R(D-1) | 2 | A | 21 | 19 | 17 | 0.18 | 70 | Comp. |
| 708 | 705B(D-1) | 705G(D-1) | 705R(D-1) | 2 | B | 5 | 5 | 8 | 0.13 | 80 | Inv. |
| 709 | 706B(D-1) | 706G(D-1) | 706R(D-1) | 2 | C | 6 | 9 | 9 | 0.12 | 95 | Inv. |
| 710 | 101B(D-2) | 101G(D-2) | 101R(D-2) | 15 | A | 27 | 49 | 35 | 0.25 | 30 | Comp. |
| 711 | 707B(D-2) | 707G(D-2) | 707R(D-2) | 15 | B | 30 | 19 | 27 | 0.24 | 45 | Comp. |
| 712 | 708B(D-2) | 708G(D-2) | 708R(D-2) | 15 | C | 42 | 42 | 33 | 0.21 | 40 | Comp. |
| 713 | 101B(D-2) | 101G(D-2) | 101R(D-2) | 8 | A | 41 | 44 | 22 | 0.25 | 60 | Comp. |
| 714 | 709B(D-2) | 709G(D-2) | 709R(D-2) | 8 | B | 3 | 4 | 3 | 0.10 | 85 | Inv. |
| 715 | 710B(D-2) | 710G(D-2) | 710R(D-2) | 8 | C | 9 | 5 | 4 | 0.12 | 90 | Inv. |
| 716 | 101B(D-2) | 101G(D-2) | 101R(D-2) | 2 | A | 8 | 13 | 18 | 0.23 | 65 | Comp. |
| 717 | 711B(D-2) | 711G(D-2) | 711R(D-2) | 2 | B | 4 | 8 | 8 | 0.14 | 90 | Inv. |
| 718 | 712B(D-2) | 712G(D-2) | 712R(D-2) | 2 | C | 6 | 4 | 3 | 0.12 | 95 | Inv. |

A: Added to a coating solution
B: Added at 100 min. after starting chemical ripening
C: Added when completing chemical ripening As can be seen from Table 10, Samples, in which the total amount of desensitizing dye added was not more than 10 mg/mol AgX, satisfied requirements of the invention, reproducing even gray image density and superior reproduction of fine texts.

TABLE 11

| Sample No. | Reference Emulsion | Reflectance (%) | Variation of Average gradation (%) ΔγB | ΔγG | ΔγR | Density Evenness | Text Reproduction | Remark |
|---|---|---|---|---|---|---|---|---|
| 201 | 201 | 8.5 | 56 | 24 | 9 | 0.29 | 15 | Comp. |
| 801 | 201 | 7.5 | 54 | 22 | 9 | 0.34 | 30 | Comp. |
| 802 | 201 | 11 | 50 | 18 | 7 | 0.23 | 5 | Comp. |
| 204 | 204 | 8.5 | 5 | 5 | 7 | 0.14 | 100 | Inv. |
| 803 | 204 | 7.5 | 6 | 5 | 6 | 0.14 | 100 | Inv. |
| 804 | 204 | 11 | 5 | 6 | 7 | 0.09 | 75 | Inv. |

As can be seen from Table 11, Sample 801 decreased in reflectance at 670 nm, as compared to Sample 201, slightly reducing color doubling of super-fine lines but uneven scanning lines markedly occurred, lowering acceptability for unevenness of scanning lines. Sample 802 exhibited more than 10% of reflectance at 760 nm, markedly lowering acceptability for color doubling of super-fine lines. Compared to Sample 204, Sample 803, which exhibited reflectance lower than that of Sample 204, maintained the same acceptability for uneven scanning lines at high levels. Sample 804 having more than 10% of reflectance exhibited enhanced acceptability for uneven scanning lines but acceptability for doubling of super-fine lines was slightly lowered. As can be seen from these results, in cases when reflected light is not more than 10% of incident light, acceptability for uneven scanning and doubling of super fine lines were enhanced.

Example 9

Samples 101 to 111 were subjected to scanning exposure and processing, and evaluated in the same manner as in Example 1, except that processing was started at 30 sec. after completing exposure. Results are shown in Table 12. In the Table, data of Example 1 was also cited.

TABLE 12

| Sample No. | 1 min. after exposure | | 30 sec. after exposure | | Remark |
|---|---|---|---|---|---|
| | Density Evenness | Text Reproduction | Density Evenness | Text Reproduction | |
| 101 | 0.27 | 35 | 0.29 | 15 | Comp. |
| 102 | 0.21 | 40 | 0.23 | 30 | Comp. |
| 103 | 0.13 | 75 | 0.15 | 75 | Inv. |
| 104 | 0.14 | 85 | 0.15 | 70 | Inv. |
| 105 | 0.15 | 90 | 0.15 | 75 | Inv. |
| 106 | 0.11 | 90 | 0.13 | 80 | Inv. |
| 107 | 0.24 | 45 | 0.26 | 15 | Comp. |
| 108 | 0.16 | 75 | 0.17 | 65 | Inv. |
| 109 | 0.14 | 80 | 0.14 | 80 | Inv. |
| 110 | 0.09 | 100 | 0.10 | 90 | Inv. |
| 111 | 0.13 | 85 | 0.13 | 85 | Inv. |

As can be seen from Table 12, in cases when the interval between completion of scanning exposure and start of processing was shortened to 30 sec., Samples 101, 102 and 107 exhibited markedly reduced acceptability for doubling of super-fine lines. On the contrary, Samples 103 to 106 and 108 to 111 exhibited no or little reduction in acceptability for doubling of super-fine lines, even when the interval of time was shortened.

What is claimed is:

1. A silver halide photographic light sensitive material comprising a support having thereon a yellow dye image forming layer, a magenta dye image forming layer and a cyan dye image forming layer, wherein when the photographic material is subjected to exposure of not more than $10^{-6}$ second per pixel element and further to color developing to form yellow, magenta and cyan images, a variation at multiple exposure, based on non-multiple exposure, of an average gradation which is a slope that connects two points corresponding to densities of 0.5 and 1.5 on a characteristic curve of each of the yellow, magenta and cyan images is not more than 10%; and the yellow dye image forming layer, magenta dye image forming layer and cyan dye image forming layer each comprises light sensitive silver halide grains having a chloride content of not less than 95 mol %.

2. The photographic material of claim 1, wherein said photographic material satisfies the following requirements (1) and (2):

$$|\gamma m(Y)/\gamma m(M)-\gamma s(Y)/\gamma s(M)|\leqq 0.2 \quad (1)$$

$$|\gamma m(C)/\gamma m(M)-\gamma s(C)/\gamma s(M)|\leqq 0.15 \quad (2)$$

wherein γm(Y), γm(M) and γm(C) represent an average gradation at multiple exposure of yellow, magenta and cyan images, respectively; γs(Y), γs(M) and γs(C) represent an average gradation at non-multiple exposure of yellow, magenta and cyan images, respectively.

3. The photographic material of claim 1, wherein said photographic material satisfies the following requirements (3) and (4):

$$|Dl(Y)/Dl(M)-Ds(Y)/Ds(M)|\leqq 0.5 \quad (3)$$

$$|Dl(C)/Dl(M)-Ds(C)/Ds(M)|\leqq 0.5 \quad (4)$$

wherein Dl(Y), Dl(M) and Dl(C) represent a reflection density of a square portion with an area of (beam diameter×1000)$^2$, obtained when subjected to scanning exposure in the maximum exposure amount and at 25% of overlap between light beam rasters with respect to yellow, magenta and cyan images, respectively, and Ds(Y), Ds(M) and Ds(C) represent a reflection density of a square portion with an area of (beam diameter×2)$^2$ when subjected to scanning exposure in the maximum exposure amount and at 25% of overlap between light beam rasters with respect to yellow, magenta and cyan images, respectively.

4. The photographic material of claim 1, wherein on a microdensitometer measurement curve of a magenta fine line image obtained by subjecting the photographic material to exposure in the form of a line of one pixel width, the ratio of toe-width to half-width is from 1.2 to 3.0.

5. The photographic material of claim 1, wherein said yellow dye image forming layer, said magenta dye image forming layer and said cyan dye image forming layer each comprises light sensitive silver halide grains having a high bromide-localized phase in the corner or edge of said silver halide grains.

* * * * *